US011562854B1

(12) United States Patent
Kaelin et al.

(10) Patent No.: US 11,562,854 B1
(45) Date of Patent: Jan. 24, 2023

(54) DUAL SLOTTED BOBBIN MAGNETIC COMPONENT WITH TWO-LEGGED CORE

(71) Applicant: Bel Power Solutions, Inc., Santa Clara, CA (US)

(72) Inventors: Rosmarie Kaelin, Lenzburg (CH); Michal Sir, Uster (CH)

(73) Assignee: BEL POWER SOLUTIONS INC., Santa Clara, CA (US)

( * ) Notice: Subject to any disclaimer, the term of this patent is extended or adjusted under 35 U.S.C. 154(b) by 440 days.

(21) Appl. No.: 16/864,815

(22) Filed: May 1, 2020

Related U.S. Application Data

(60) Provisional application No. 62/873,508, filed on Jul. 12, 2019.

(51) Int. Cl.

| | |
|---|---|
| ***H01F 27/32*** | (2006.01) |
| ***H01F 41/06*** | (2016.01) |
| ***H01F 27/24*** | (2006.01) |
| ***H01F 27/28*** | (2006.01) |
| ***H01F 27/29*** | (2006.01) |
| ***H01F 41/02*** | (2006.01) |
| ***H01F 41/063*** | (2016.01) |

(52) U.S. Cl.
CPC ..... *H01F 27/325* (2013.01); *H01F 27/24* (2013.01); *H01F 27/2804* (2013.01); *H01F 27/2823* (2013.01); *H01F 27/2866* (2013.01); *H01F 27/292* (2013.01); *H01F 41/0206* (2013.01); *H01F 41/063* (2016.01); *H01F 2027/2809* (2013.01)

(58) Field of Classification Search
CPC ..... H01F 27/325; H01F 41/063; H01F 27/24; H01F 27/2804; H01F 27/2823; H01F 27/2866; H01F 27/292; H01F 41/0206; H01F 2027/2809
See application file for complete search history.

(56) References Cited

U.S. PATENT DOCUMENTS

| | | | |
|---|---|---|---|
| 3,083,930 | A | 4/1963 | Brekke |
| 4,419,536 | A | 12/1983 | Doyle et al. |
| 4,473,811 | A | 9/1984 | Schauble |
| 4,924,200 | A | 5/1990 | Kitahara et al. |
| 5,010,314 | A | 4/1991 | Estrov |
| 5,175,525 | A | 12/1992 | Smith |
| 5,332,989 | A | 7/1994 | Ching |

(Continued)

*Primary Examiner* — Elvin G Enad
*Assistant Examiner* — Malcolm Barnes
(74) *Attorney, Agent, or Firm* — Patterson Intellectual Property Law, P.C.

(57) ABSTRACT

A magnetic component for an electronic circuit includes first and second bobbins having respective core-receiving passageways. Each bobbin includes multiple slots with a winding insert in each slot. The winding inserts function as windings as well as guides for winding a coil of wire around the respective bobbins. The first and second bobbins are positioned on respective first and second legs of a magnetic core. The coils of wire are wound on the two bobbins in opposite directions such that the magnetic fluxes provided by the coils are in phase. The winding inserts have connection prongs that can be positioned in opposite direction such that the winding inserts of the first bobbin are connectable to a first printed circuit board and the winding inserts of the second bobbin are connectable to a second printed circuit board.

10 Claims, 16 Drawing Sheets

(56) References Cited

U.S. PATENT DOCUMENTS 6,201,463 B1 3/2001 Yamashita et al.
6,278,353 B1 8/2001 Downing et al.
6,587,023 B2 7/2003 Miyazaki et al.
6,853,284 B2 2/2005 Nagai et al.
6,856,227 B2 2/2005 Ushio et al.
7,236,079 B2 6/2007 Lin
7,498,921 B1 * 3/2009 Wang ..... H01F 27/2852 336/200
7,567,164 B2 * 7/2009 Chin ..... H01F 30/06 336/198
8,179,222 B2 5/2012 Lee et al.
8,395,470 B2 3/2013 Lin
9,000,878 B1 * 4/2015 Lazzerini ..... H01F 27/2866 336/229
9,202,621 B2 12/2015 Wild
2007/0241853 A1 10/2007 Yang et al.
2008/0180205 A1 * 7/2008 Tsai ..... H01F 27/2866 336/192
2009/0201114 A1 * 8/2009 Hasenour ..... H01F 5/04 29/605
2009/0278648 A1 * 11/2009 Teng ..... H01F 27/2866 336/199
2009/0293260 A1 * 12/2009 Lee ..... H01F 41/041 335/299
2009/0309684 A1 * 12/2009 Tsai ..... H01F 27/325 336/105
2010/0265029 A1 * 10/2010 Xiong ..... H01F 27/323 336/232
2012/0182113 A1 * 7/2012 Pan ..... H01F 27/325 336/196
2013/0027165 A1 * 1/2013 Lin ..... H01F 27/2866 336/192
2013/0141878 A1 * 6/2013 Wu ..... H01F 27/2866 361/748
2014/0132384 A1 * 5/2014 Su ..... H01F 27/33 336/196
2014/0184378 A1 * 7/2014 Wild ..... H01F 27/325 336/207
2014/0266554 A1 * 9/2014 Sun ..... H01F 27/2866 336/208
2016/0031673 A1 * 2/2016 Chen ..... H01F 5/02 242/118
2016/0133379 A1 * 5/2016 Lin ..... H01F 27/30 336/198
2016/0133380 A1 * 5/2016 Yang ..... H01F 27/325 336/61
2016/0293324 A1 * 10/2016 Hsiao ..... H01F 27/2823
2017/0004920 A1 * 1/2017 Pan ..... H01F 27/2885
2017/0110241 A1 * 4/2017 Yang ..... H01F 27/346
2017/0278622 A1 * 9/2017 Chen ..... H01F 27/306
2019/0139697 A1 * 5/2019 Lu ..... H01F 41/04
2020/0105461 A1 * 4/2020 Fu ..... H01F 27/325
2020/0135379 A1 * 4/2020 Lu ..... H01F 27/306
2021/0280366 A1 * 9/2021 Yoon ..... H01F 27/2866

* cited by examiner

DUAL SLOTTED BOBBIN MAGNETIC COMPONENT WITH TWO-LEGGED CORE

CROSS-REFERENCES TO RELATED APPLICATIONS

This application claims benefit of U.S. Provisional Patent Application No. 62/873,508, filed Jul. 12, 2019, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE DISCLOSURE

This disclosure relates generally to magnetic components for electronic circuits and, more particularly, relates to magnetic components such as inductors and transformers having at least two bobbins positioned on spaced apart legs and having at least one winding or coil disposed on the bobbins.

BACKGROUND

Magnetic components are generally known in the art for use in electronic circuits for various applications such as converting power or voltage. Such components are commonly found in many types of circuits and electronic devices such as power supplies and converters, amplifiers, voltage regulators, etc. Many conventional magnetic components for electronic circuits utilize a bobbin around which one or more conductive windings or coils are positioned. A magnetically permeable core is positioned near the bobbin structure for manipulating or shaping a magnetic field generated when electric current is passed through the one or more conductive windings. In many conventional magnetic components, the core extends into an axial passage in the bobbin on the interior of the winding or coil loops.

Conventional transformer devices generally include a primary winding wrapped a first number of turns around the bobbin, and a second winding wrapped a second number of turns around the same bobbin. Each winding may be associated with different portions of an electronic circuit or alternatively different electronic circuits altogether. By controlling the number of turns and location of each winding, desired performance characteristics of the transformer may be achieved.

One problem with conventional bobbin-wound magnetic components such as transformers that utilize multiple windings is proper positioning of the various coils. Minor variations in winding placement can affect device performance. As such, precision winding configurations are necessary to ensure consistent and reliable performance. However, in many applications, complex magnetic field interactions are desired among the primary and secondary windings. Such magnetic field interactions may be required for example to reduce effects of the magnetic component on surrounding circuit elements or to reduce high frequency effects and power losses. Conventional winding configurations using conductive wires wound around a bobbin may be inadequate for such complex field interactions due in part to problems with wire positioning, wire size, etc.

Another problem associated with conventional magnetic component devices includes movement of planar windings during positioning of one or more wire coils on the bobbin structure between the planar windings. The planar windings may become unintentionally misaligned or may fall out during the coil winding process. Additionally, coil placement between planar windings may cause the planar windings to flex or bow axially, resulting in uneven coil placement.

What is needed then are improvements in the devices and methods for magnetic components and associated bobbin structures for positioning one or more conductive windings.

BRIEF SUMMARY

One aspect of the embodiments disclosed herein is a magnetic component for an electronic circuit includes first and second bobbins having respective core-receiving passageways. Each bobbin includes multiple slots with a winding insert in each slot. The winding inserts function as windings as well as guides for winding a coil of wire around the respective bobbins. The first and second bobbins are positioned on respective first and second legs of a magnetic core. The coils of wire are wound on the two bobbins in opposite directions such that the magnetic fluxes provided by the coils are in phase. The winding inserts have connection prongs that can be positioned in opposite direction such that the winding inserts of the first bobbin are connectable to a first printed circuit board and the winding inserts of the second bobbin are connectable to a second printed circuit board.

Another aspect of the embodiments disclosed herein is a magnetic component for an electronic circuit. The magnetic component comprises a first bobbin and a second bobbin. Each bobbin comprises a first flange at a first end of the bobbin and a second flange at a second end of the bobbin. Each bobbin further comprises an elongated bobbin tube positioned between the first flange and the second flange. The bobbin tube defines a core-receiving passageway along a respective axis of elongation. The core-receiving passageway has a passageway length. A plurality of slots are defined in the bobbin tube. Each slot is oriented substantially transversely to the bobbin axis of elongation. The magnetic component further comprises a first plurality of winding inserts. Each winding insert of the first plurality of winding inserts is positioned in a respective slot of the bobbin tube of the first bobbin. Each winding insert of the first plurality of winding inserts has a first plurality of connector prongs extending from the winding insert. The magnetic component further comprises a second plurality of winding inserts. Each winding insert of the second plurality of winding inserts is positioned in a respective slot of the bobbin tube of the second bobbin. Each winding insert of the second plurality of winding inserts has a second plurality of connector prongs extending from the winding insert. A first coil is wound around the bobbin tube of the first bobbin in a clockwise direction. The first coil has a plurality of turns. Each turn is wound between adjacent ones of the first plurality of winding inserts or between one of the first plurality winding inserts and one of the first flange and the second flange of the first bobbin. A second coil is wound around the bobbin tube of the second bobbin in a counterclockwise direction. The second coil has a plurality of turns. Each turn is wound between adjacent ones of the second plurality of winding inserts or between one of the second plurality winding inserts and one of the first flange and the second flange of the second bobbin. The magnetic component further comprises a magnetic core. The magnetic core comprises at least a first core leg and a second core leg. The first core leg is positioned in the core-receiving passage of the first bobbin; and the second core leg is positioned in the core-receiving passage of the second bobbin.

In certain aspects in accordance with this embodiment, the first bobbin is positioned on the first leg of the magnetic core with the first plurality of connector prongs directed in a first direction. The second bobbin is positioned on the second leg of the magnetic core with the second plurality of connector prongs directed in a second direction. In one configuration of the embodiment, the second direction is opposite the first direction.

In certain aspects in accordance with this embodiment, the first plurality of connector prongs are engageable with a first printed circuit board; and the second plurality of connector prongs are engage able with a second printed circuit board.

In certain aspects in accordance with this embodiment, the second printed circuit board is parallel with the first printed circuit board.

In certain aspects in accordance with this embodiment, each winding insert comprises a first conductive sheet having a respective central opening, a second conductive sheet having a respective central opening; and an insulating sheet having a respective central opening. The insulating sheet is positioned between the first conductive sheet and the second conductive sheet. The central openings of the first conductive sheet, the second conductive sheet and the insulating sheet are sized to accommodate an outer periphery of one of the first core leg and the second core leg.

In certain aspects in accordance with this embodiment, each conductive sheet and the insulating sheet of each winding insert has a respective centerline and has a respective first side and a respective second side. Each conductive sheet includes a first connector stub having at least a first connector prong extending therefrom. The first connector stub is positioned a first distance from the centerline of the conductive sheet in a first lateral direction. Each conductive sheet also includes a second connector stub having at least a second connector prong extending therefrom. The second connector stub is positioned a second distance from the centerline of the conductive sheet in a second lateral direction opposite the first lateral direction. The second distance is greater than the first distance. The first conductive sheet is positioned on a first side of the insulating sheet with the second side of the first conductive sheet adjacent to the first side of the insulating sheet such that the first connector prong positioned in the first direction with respect to the centerline of the insulating sheet. The second conductive sheet is positioned on a second side of the insulating sheet with the second side of the second conductive sheet adjacent to the second side of the insulating sheet such that the first connector prong of the second conductive sheet is positioned in the second direction with respect to the centerline of the insulating sheet.

In certain aspects in accordance with this embodiment, the magnetic core comprises a first core section and a second core section. Each core section comprises a core body having an inner surface and an outer surface. A first core leg extends from the inner surface. A second core leg extends from the inner surface. The second core leg is spaced apart from the first core leg by a selected distance. The selected distance is chosen such that the core-receiving passageways of the first and second bobbins are positionable on the first and second core legs without interference.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
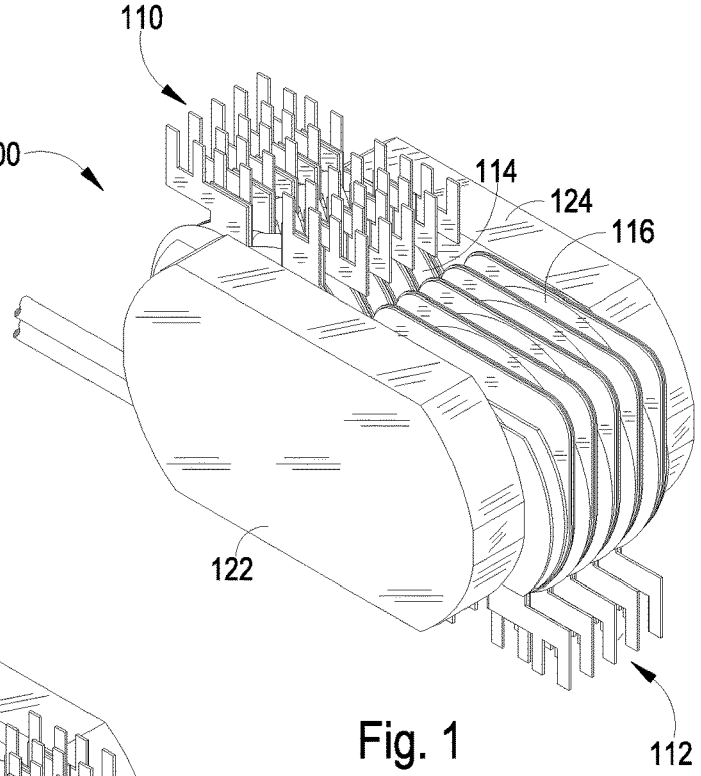
FIG. 1 illustrates an upper front perspective view of an embodiment of a magnetic component.
Figure 2:
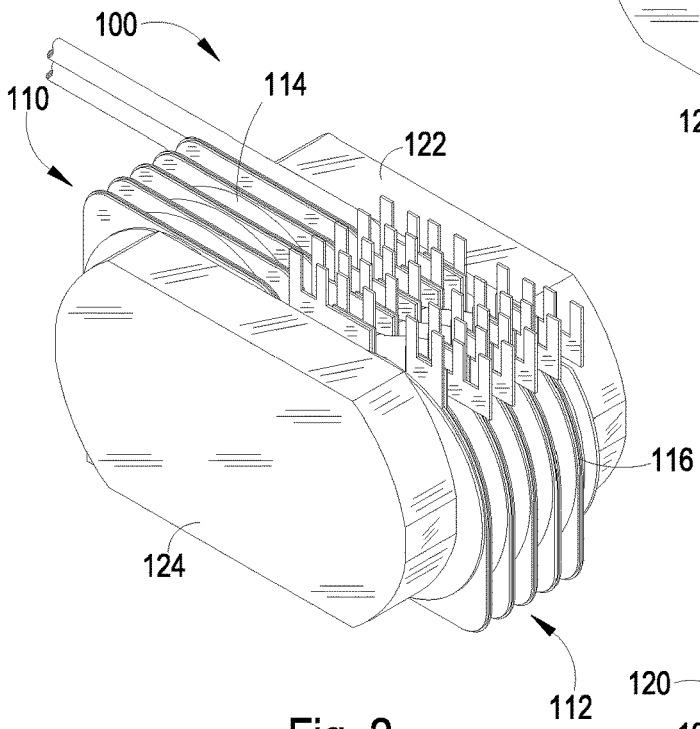
FIG. 2 illustrates a lower rear perspective view of the magnetic component of FIG. 1.

Embodiments of the magnetic component are disclosed herein with respect to the attached drawings.

As shown in FIGS. 1-7, a magnetic component 100 includes a first bobbin 110 and a second bobbin 112. A first coil 114 is wound on the first bobbin, and a second coil 116 is wound on the second bobbin.

A magnetic core 120 (FIG. 3) comprises a first core section 122 and a second core section 124. In the embodiment of FIGS. 1-7, the first core section and the second core section can be identical as described below or the two core sections can be different as further described below. A respective portion of each section of the magnetic core is engaged with the first bobbin 110 and the second bobbin 112 as described below.

Figure 4:
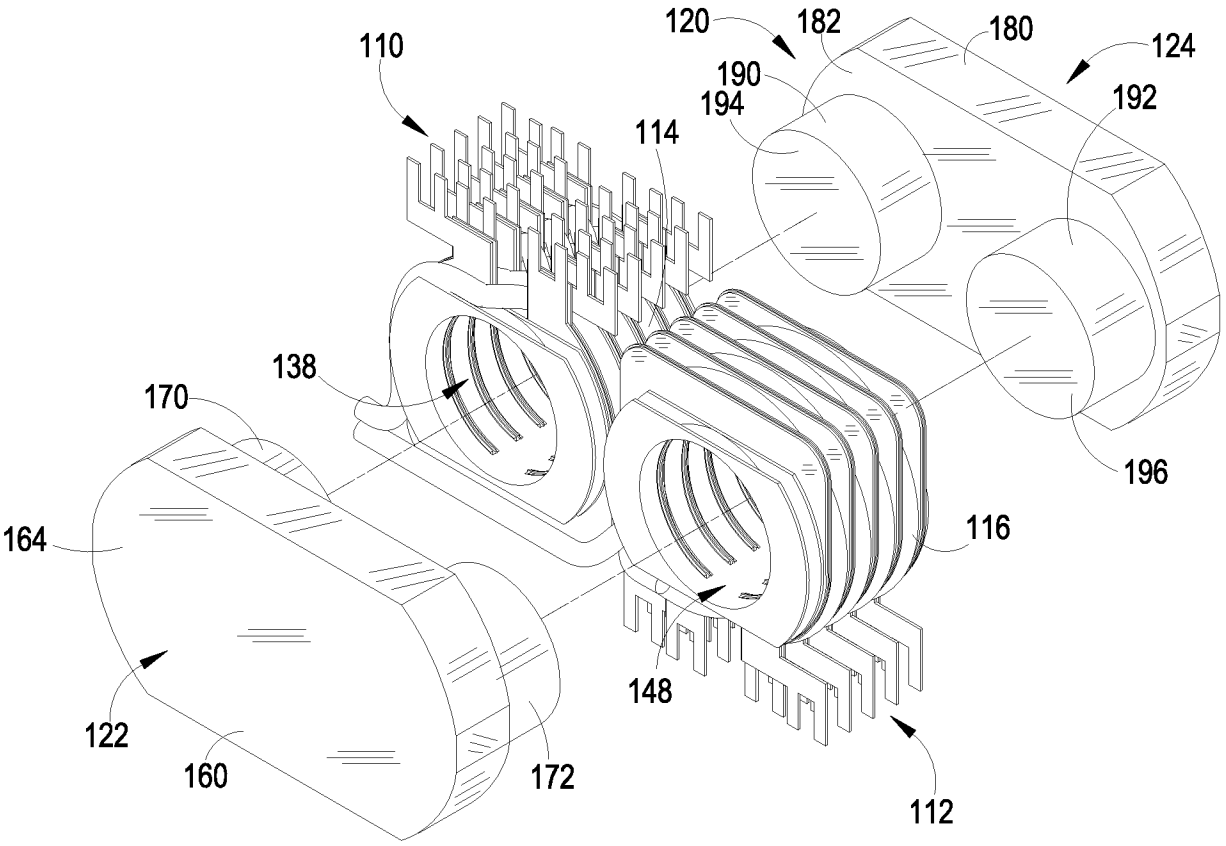
FIG. 4 illustrates an exploded upper front perspective view of the magnetic component of FIG. 1 showing the first and second bobbins and the two core halves.
Figure 5:
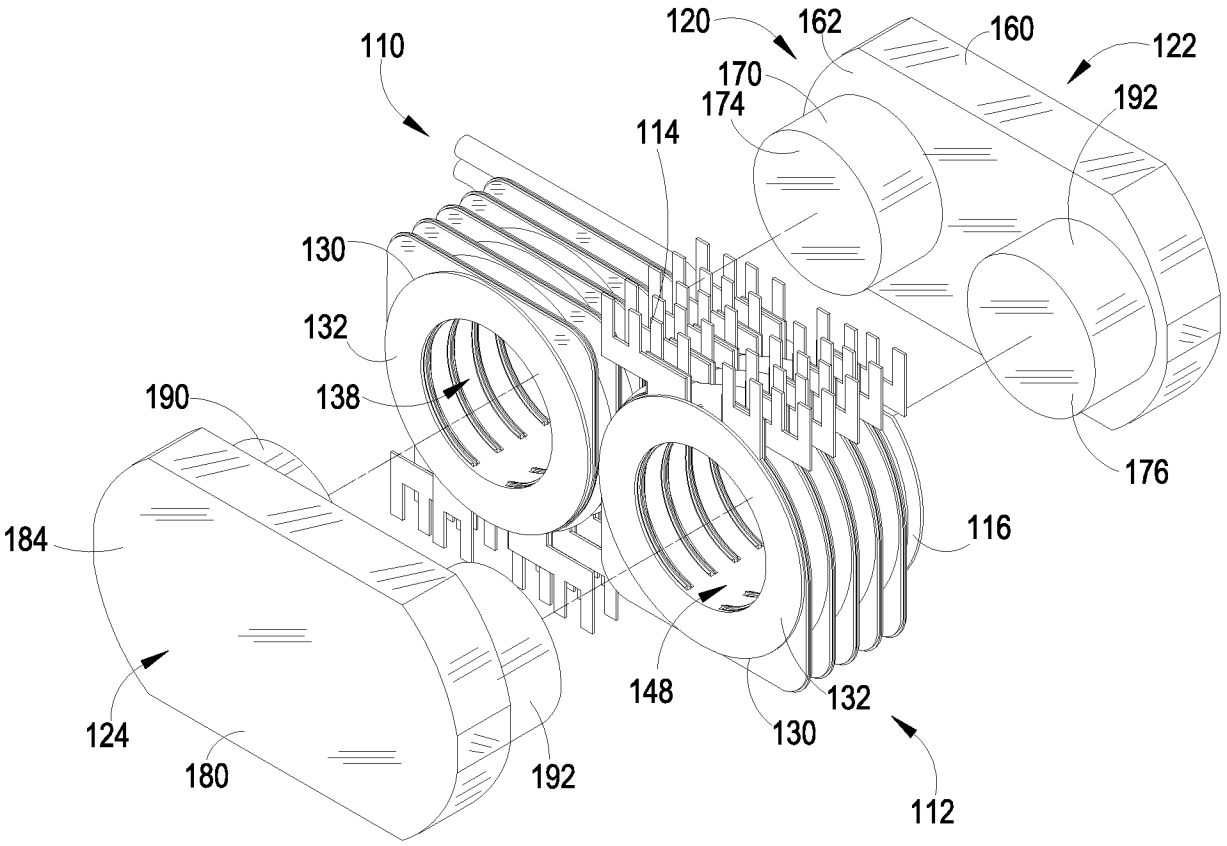
FIG. 5 illustrates an exploded lower rear perspective view of the magnetic component of FIG. 1.

As shown in FIGS. 4 and 5, the first bobbin 110 comprises a respective first flange 130 having an outer surface 132. The first bobbin comprises a respective second flange 134 having an outer surface 136. A respective core-receiving passageway 138 extends between the outer surfaces of the first and second flanges of the first bobbin. The first coil 114 is wound around the core-receiving passageway of the first bobbin between the first and second flanges as described below.

The second bobbin 112 comprises a respective first flange 140 having an outer surface 142. The second bobbin comprises a second flange 144 having an outer surface 146. A respective core-receiving passageway 148 extends between the outer surfaces of the first and second flanges of the second bobbin. The second coil 116 is wound around the core-receiving passageway of the second bobbin between the first and second flanges as described below. Each core-receiving passageway has a length $L_{BOBBIN}$ (FIG. 6) from the outer surface of the respective first flange to the outer surface of the respective second flange.

Figure 3:
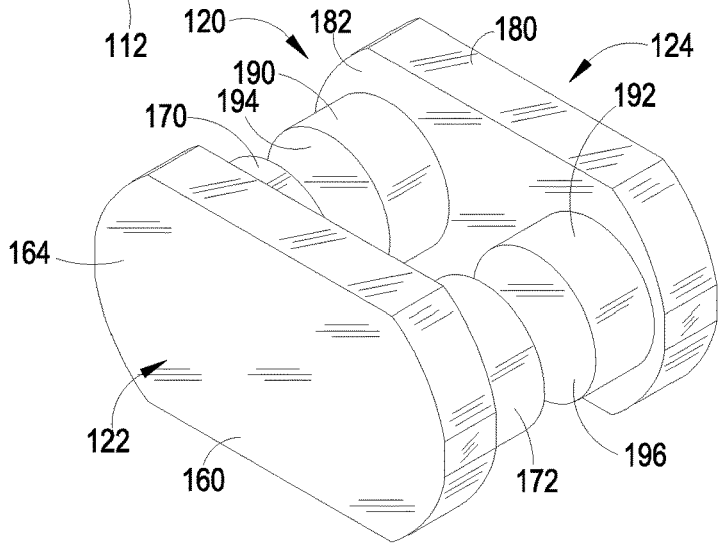
FIG. 3 illustrates an upper front perspective view of the magnetic core of the magnetic component of FIG. 1, the end surfaces of the core halves spaced apart to illustrate an exaggerated gap between the end surfaces of the core legs.

As shown in FIG. 3, the magnetic core 120 comprises the first core section 122 and the second core section 124. In the illustrated embodiment of FIGS. 1-7, the two core sections are identical and are referred to in the following description as the first core half and the second core half. The first core half comprises a respective core body 160 having a respective inner surface 162 (facing the second core half) and a respective outer surface 164. A respective first core leg 170 and a respective second core leg 172 extend perpendicularly from the inner surface of the first core body. The first leg extends to a respective end surface 174. The second leg extends to a respective end surface 176. In the illustrated embodiment, the core legs are cylindrical (e.g., have a circular profile). In other embodiments (not shown), the core legs can have a square profile or another geometric shape. The first and second core legs are spaced apart laterally along the inner surface of the core body to accommodate the two bobbins in the lateral spaced apart relationship illustrated in FIGS. 1, 2 and 4-7. Accordingly, the two bobbins can be positioned on the core legs without interference between the structures of the two bobbins. As used in this context, the structures of the two bobbins include the structures of winding inserts and the coils as described in more detail below.

As further shown in FIG. 3, the second core half 124 of the magnetic core 120 comprises a respective core body 180 having an inner surface 182 (facing the first core half) and an outer surface 184. A first core leg 190 and a second core leg 192 extend perpendicularly from the inner surface of the second core body. The first leg extends to a respective end surface 194. The second leg extends to a respective end surface 196. The first and second core legs of the second core half have profiles corresponding to the first and second core legs of the first core half. The first and second core legs of the second core half are spaced apart by the same lateral distance as the first core leg 170 and the second core leg 172 of the first core half 122 such that the respective first core legs are aligned within the core-receiving passageway 138 of the first bobbin 110 and such that the respective second core legs are aligned within the core-receiving passageway 148 of the second bobbin 112. In the illustrated embodiment, the lateral distance between the centers of the two core legs and the centers of the core-receiving passageway is approximately 20 millimeters.

When the first and second core legs 170, 172 of the first core half 122 and the first and second core legs 190, 192 of the second core half 124 are positioned within the first and second bobbins 110, 112, the respective end surfaces 174, 176, 194, 196 of the core legs can be spaced apart by a gap 198 shown in FIG. 3. The width of the gap is exaggerated in FIG. 3. Alternatively, the respective end surfaces of the legs may abut within the bobbins.

Figure 6:
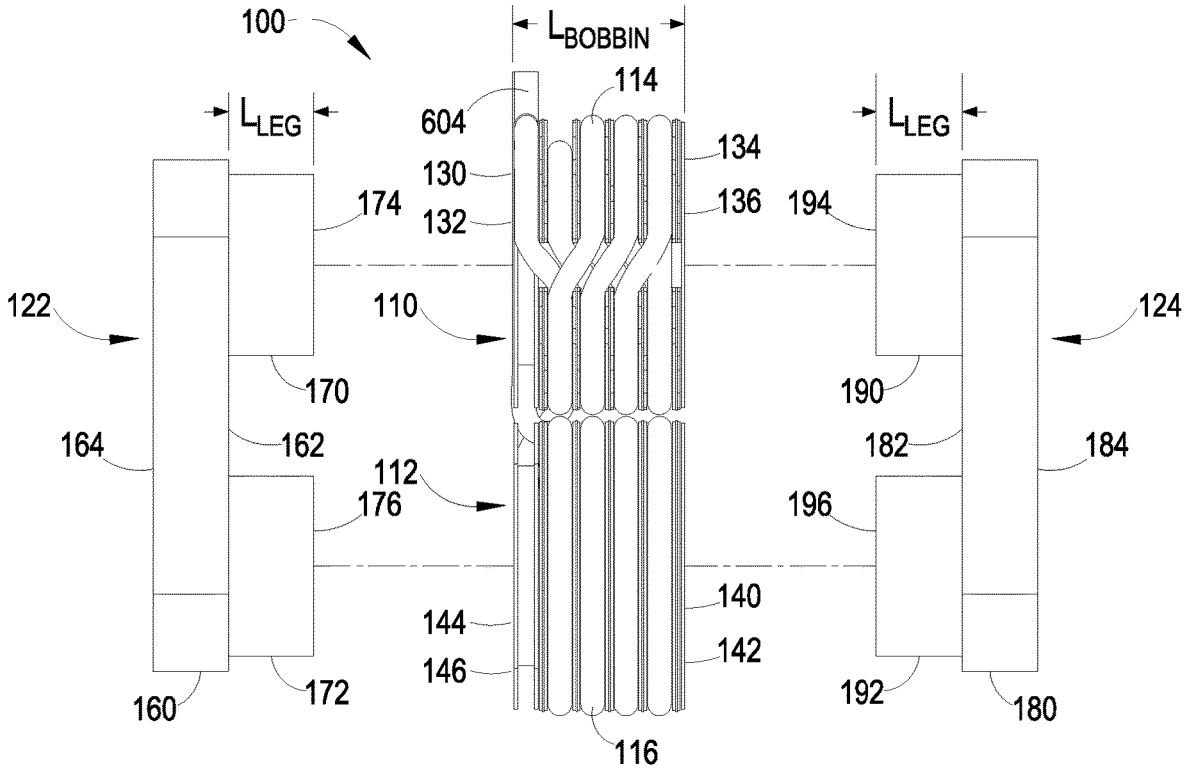
FIG. 6 illustrates an exploded top plan view of the magnetic component of FIG. 1.
Figure 7:
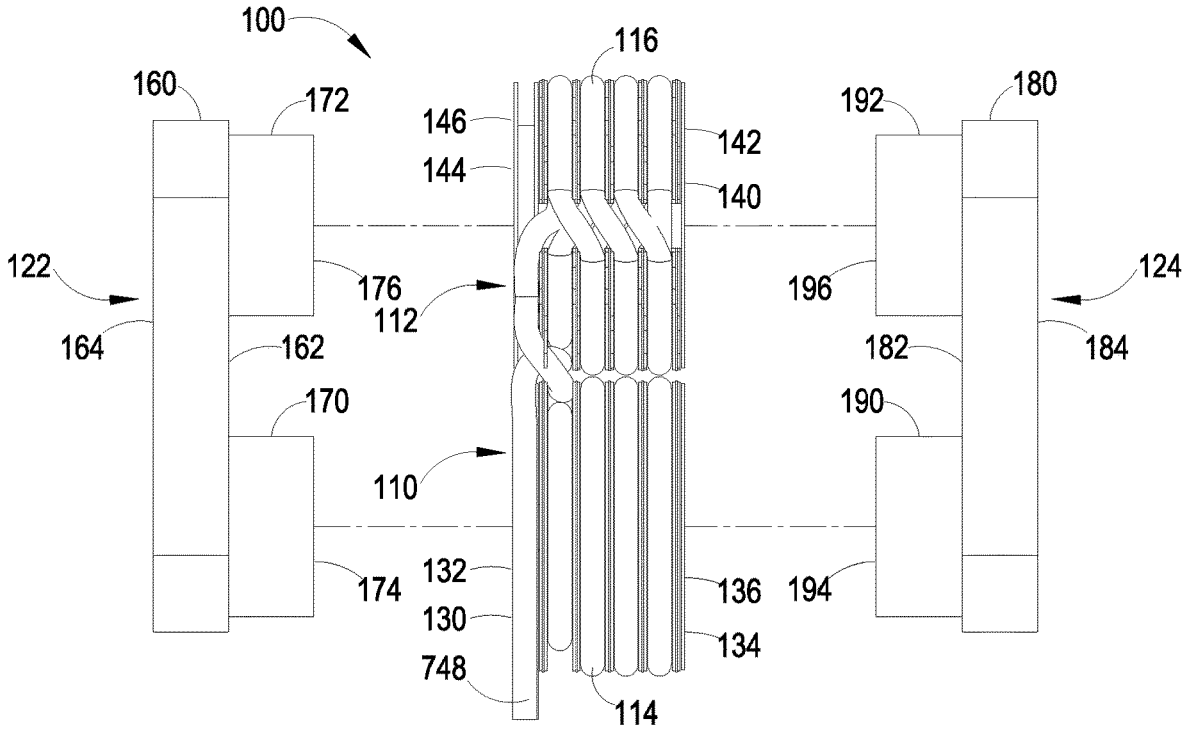
FIG. 7 illustrates an exploded bottom plan view of the magnetic component of FIG. 1
Figure 8:
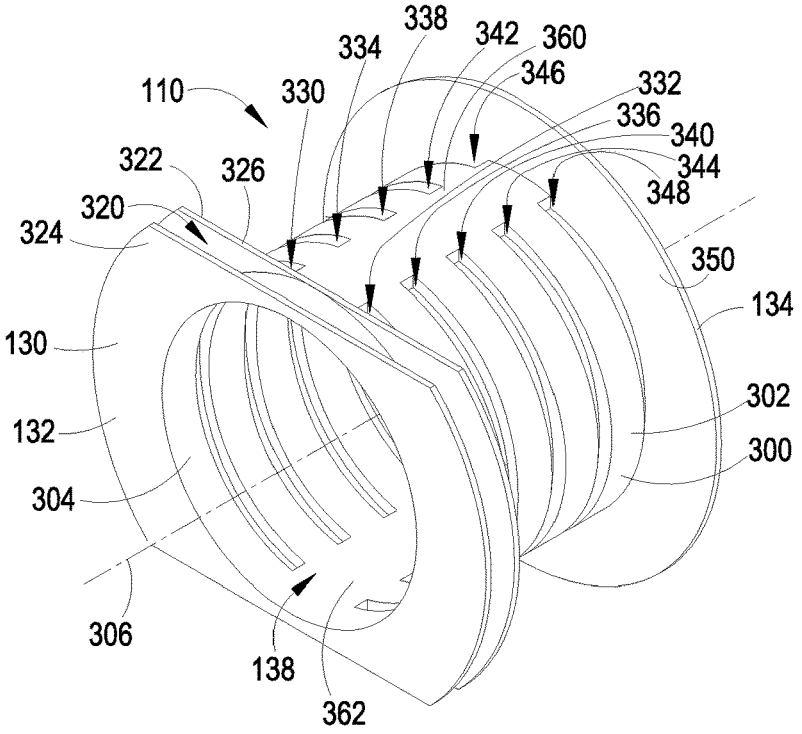
FIG. 8 illustrates an upper front perspective view of one of the bobbins of FIG. 1.
Figure 9:
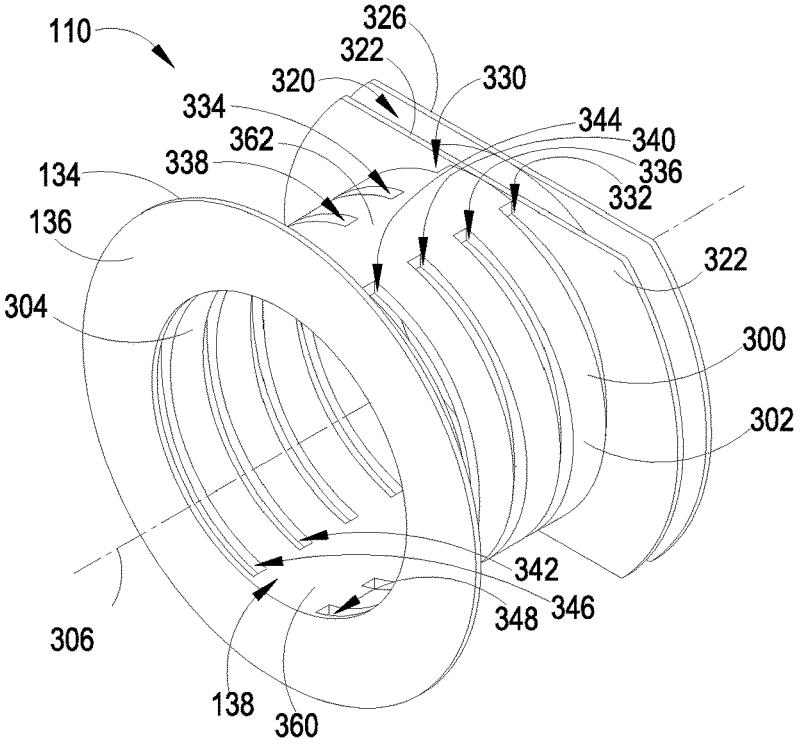
FIG. 9 illustrates a lower rear perspective view of the bobbin of FIG. 8.

As shown in FIG. 6, the first core leg 170 and the second leg 172 of the first core half 122 have a leg length $L_{LEG}$ from the inner surface 162 of the core body 160 to the respective end surfaces 174, 176 of the core legs. The first core leg 190 and the second leg 192 of the second core half 124 have a corresponding length from the inner surface 182 of the core body 180 to the respective end surfaces 194, 196 of the core legs. The length $L_{LEG}$ is selected based on the length $L_{BOBBIN}$ of the first core-receiving passageway 138 in the first bobbin 110 and the length of the second core-receiving passageway 148 in the second bobbin 112. The lengths of the core legs are determined by the presence or absence of the gap 198 (FIG. 3) between the end surfaces of the core legs. If no gap is required, the leg length $L_{LEG}$ is selected to be one half of the core-receiving passageway length $L_{BOBBIN}$:

$$L_{LEG}=1/2\times L_{BOBBIN})$$

In the gapless version, the end surfaces 174, 176, 194, 196 of the opposing legs 170, 172, 190, 192 are abutted to form a continuous magnetic path around the two core halves 122, 124. If a gap is required between the end surfaces of the legs, the leg length $L_{LEG}$ of each leg is selected to be shorter than one half of the core-receiving passageway length by one half of a desired gap length G:

$$L_{LEG}=(1/2\times L_{BOBBIN})-(1/2\times G)=1/2\times(L_{BOBBIN}-G)$$

Alternatively, the entire gap length can be removed from only one of the opposing legs. The magnetic core may have other configurations, which are described below.

FIGS. 8-11 illustrate the structure of the first bobbin 110. In the illustrated embodiment, the first bobbin and the second bobbin 112 are identical. Thus, FIG. 8 also illustrates the structure of the second bobbin. As discussed above, the first bobbin includes the core-receiving passageway 138 between the first flange 132 and the second flange 136. The core-receiving passageway is defined by a bobbin tube 300 having an outer surface 302 and an inner surface 304. In the illustrated embodiment, the bobbin tube is cylindrical and has an inner circular cross-sectional profile selected to match the outer circular profiles of the core legs 170, 172, 190, 192. The inner diameter of the bobbin tube is selected to be slightly larger than the outer diameter of each core leg to provide a tolerance such that a core leg may be inserted into the core-receiving passageway easily without undue radial movement after the core leg is positioned. The bobbin tube has an axis of elongation 306 extending from the first flange to the second flange.

The first flange 130 of the first bobbin 112 has an annular wire guide 320 formed between the outer surface 132 of the first flange and an inner surface 322 of the first flange. The annular wire guide is defined by an outer first flange portion 324 and an inner first flange portion 326.

The bobbin tube 300 includes a plurality of axially spaced slots defined along the axial length of bobbin tube 300 in the direction of the axis of elongation 306. In the illustrated embodiment, the plurality of slots include a first slot 330, a second slot 332, a third slot 334, a fourth slot 336, a fifth slot 338, a sixth slot 340, a seventh slot 342, an eighth slot 344, a ninth slot 346 and tenth slot 348. Other embodiments (not shown) can have more slots or fewer slots.

The slots are paired on opposite sides of the axis of elongation 306. The first slot 330 and the second slot 332 are paired with each other and are positioned adjacent the inner surface 322 of the first flange 130. The first slot and the second slot are defined by the removal of an arcuate portion of the bobbin tube 300 on each side of the bobbin tube for a selected longitudinal distance (the width $W_S$ of each slot) and for a selected lateral (or transverse) distance into the bobbin tube (the depth $D_S$ of each slot). In the illustrated embodiment, the width $W_S$ of each slot is approximately 0.64 millimeter, and the depth $D_S$ of each slot is approximately 5.15 millimeters. In like manner, the third slot 334 and the fourth slot 336 are paired with each other and are spaced apart from the first slot and the second slot, respectively, by a winding pitch Pw such that an arcuate portion of the bobbin tube remains between the pairs of slots. In the illustrated embodiment, the winding distance $D_W$ is approximately 2.215 millimeters. In like manner, the fifth slot 338 and the sixth slot 340 are paired with each other and are spaced apart from the third slot and the fourth slot by the winding distance. In like manner, the seventh slot 342 and the eighth slot 344 are paired with each other and are spaced apart from the fifth slot and the sixth slot by the winding distance. In like manner, the ninth slot 346 and the tenth slot 348 are paired with each other and are spaced apart from the seventh slot and the eighth slot by the winding distance. The ninth slot and the tenths slot are adjacent to an inside surface 350 of the second flange 132.

Figure 10:
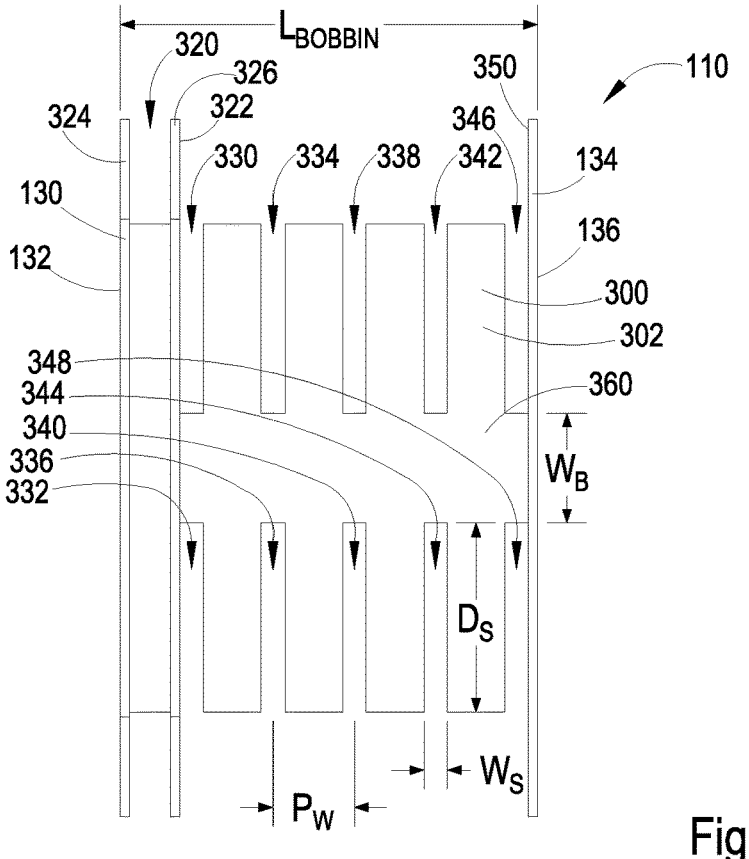
FIG. 10 illustrates a top plan view of the bobbin of FIG. 8.
Figure 11:
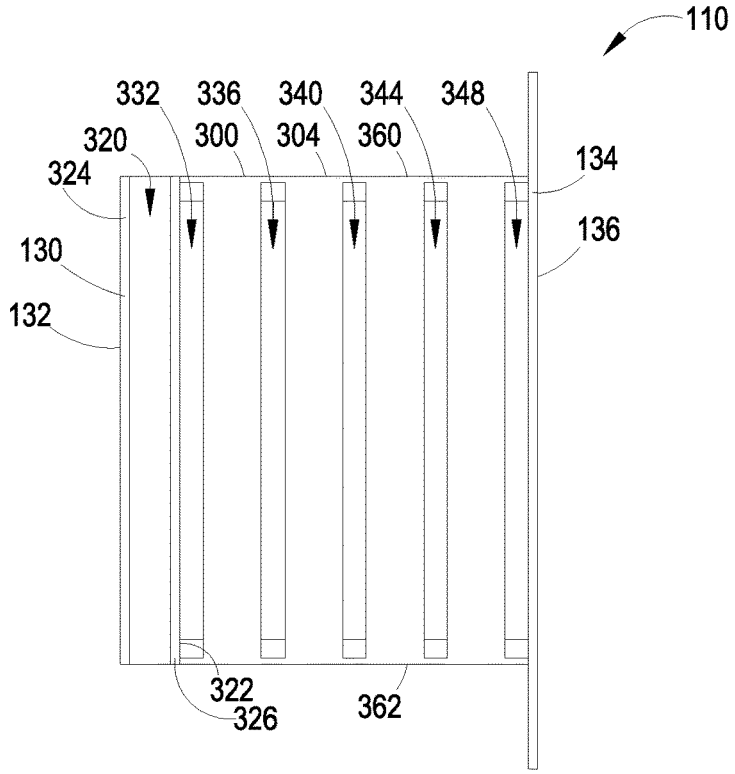
FIG. 11 illustrates a top plan view of the bobbin of FIG. 8.
Figure 12:
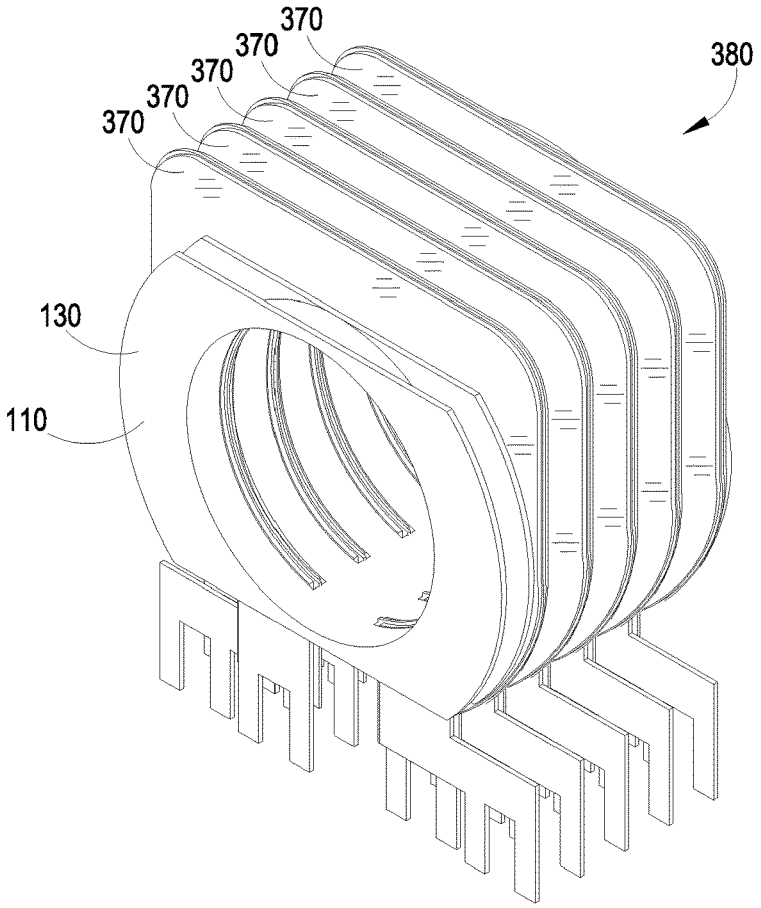
FIG. 12 illustrates an upper front perspective view of the bobbin of FIG. 8 with a plurality of winding inserts positioned in slots of the bobbin.
Figure 13:
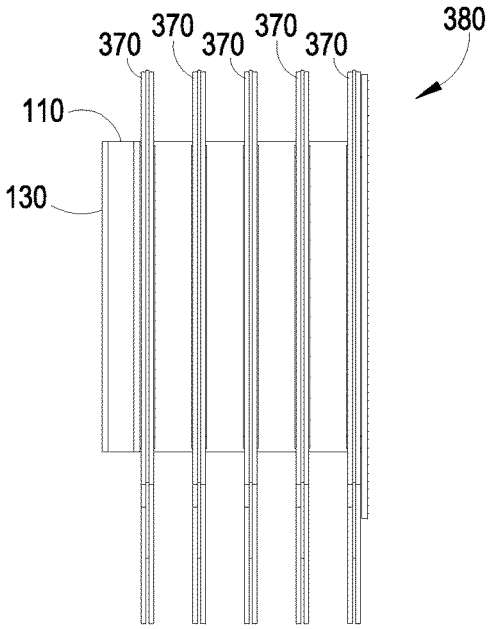
FIG. 13 illustrates a top plan view of the bobbin and the winding inserts of FIG. 12.

As illustrated in FIG. 10, the depth of each slot is selected such that the remaining material of the bobbin tube 300 comprises an upper bridge 360 and a lower bridge 362. The upper and lower bridges extend the fully length of the bobbin and interconnect the arcuate portions of the bobbin tube remaining after removal of portions of the bobbin tube to form the slots. It should be understood that "removal" of portions of the bobbin tube do not necessarily refer to the formation of a complete cylindrical bobbin tube followed by removal of material. Rather, in certain embodiments, the bobbin tube and the attached flanges 130, 134 are formed by molding, extrusion or other processes wherein the slots are formed by omitting material where the slots are located. In the illustrated embodiment, the bridges have a bridge width WB.

As shown in FIGS. 12-15, the slots 330 through 348 in the bobbin tube 300 are positioned to receive a plurality of winding inserts 370. Each winding insert is installed in a substantially radial direction onto the bobbin tube with the slots serving as guides to position the winding inserts in predetermined spaced-apart, parallel locations. FIGS. 12-15 illustrate a completed assembly 380 comprising the bobbin 110 and five winding inserts 370, which are positioned in the slots 320 through 338 of the bobbin.

The winding inserts 370 are shown in more detail in FIGS. 16-19. As shown in the exploded view in FIG. 17, each winding insert includes a first conductive sheet 390, a second conductive sheet 392 and an insulating sheet 394. Each conductive sheet comprises copper or another suitable conductive material. In the illustrated embodiment, the conductive sheet has a thickness of approximately 0.2 millimeter. In the illustrated embodiment, the insulating material comprise a suitable plastic or foam material having a thickness of approximately 0.127 millimeters.

Figure 18:
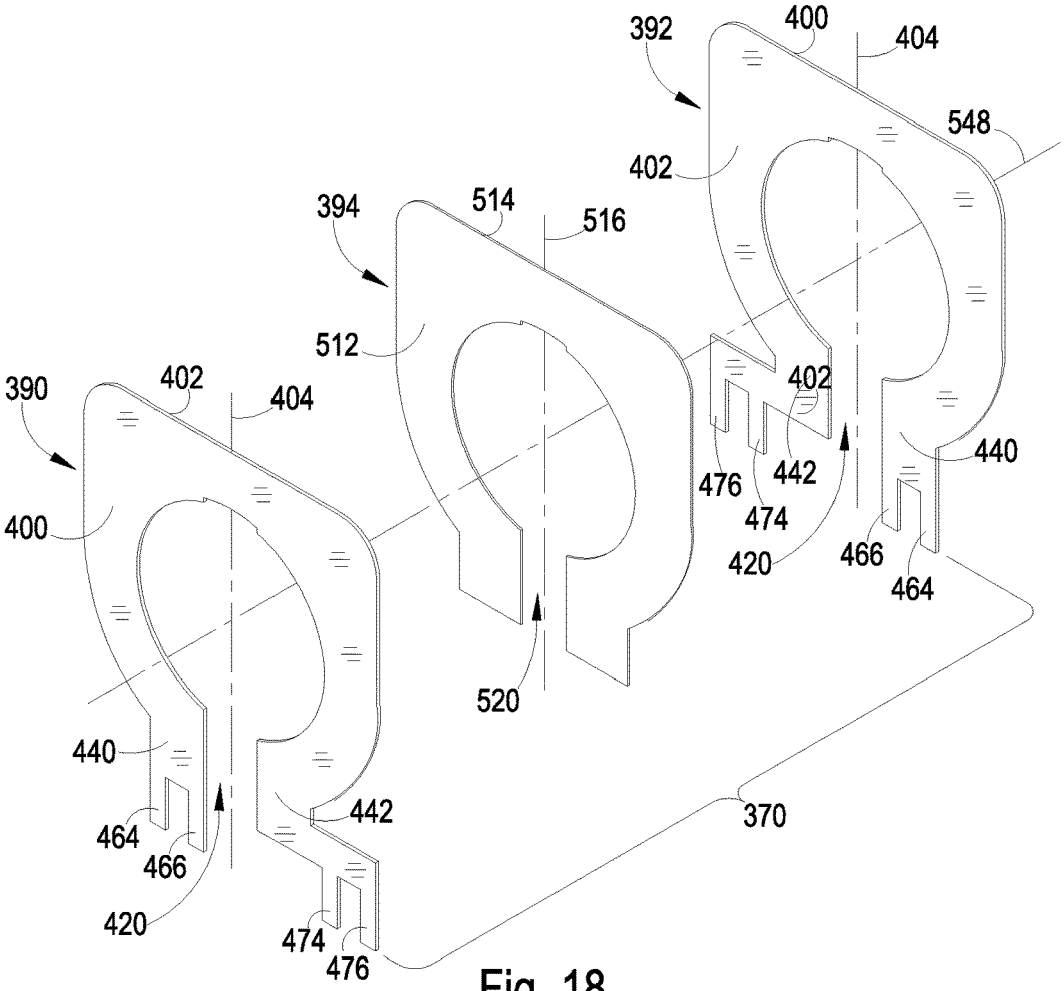
FIG. 18 illustrates an exploded upper front perspective view of the winding insert of FIG. 16 showing the first conductive sheet, the insulating sheet and the second conductive sheet.
Figure 19:
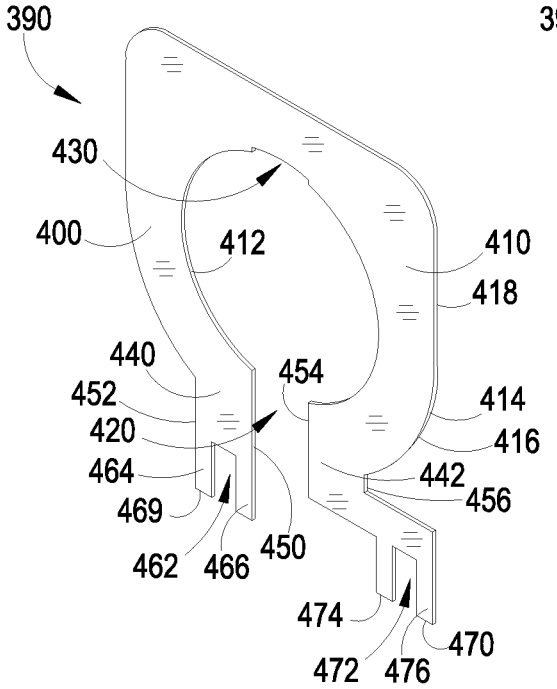
FIG. 19 illustrates an upper front perspective view of one of the conductive sheets of FIG. 18.
Figure 20:
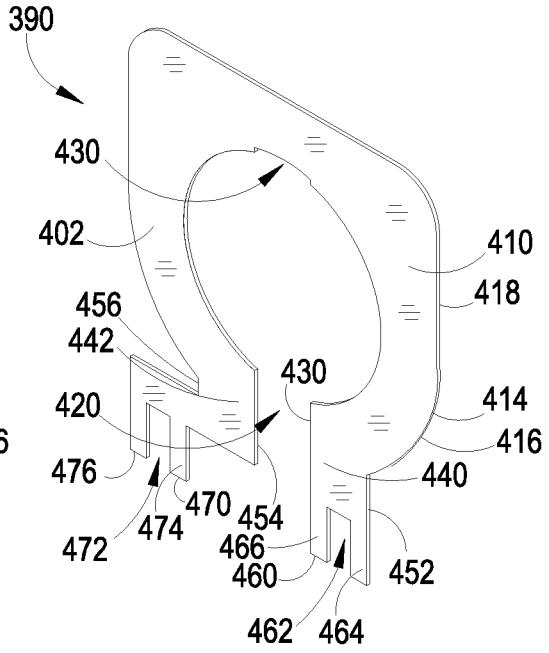
FIG. 20 illustrates an upper rear perspective view of the conductive sheet of FIG. 19.

As shown in FIGS. 19-20, the first conductive sheet 390 has a first (front) surface 400 and a second (rear) surface 402. A vertical centerline 404 (FIG. 18) passes through the first conductive sheet. The conductive sheet includes a winding loop 410 having an inner surface 412 and an outer surface 414. The inner surface of the winding loop is semiannular and has a diameter of approximately 12.3 millimeters. As used herein "semiannular" indicates that the inner surface of the winding loop is not a complete circle. In the illustrated embodiment, the outer surface of the winding loop has a semiannular lower portion 416 and a rectangular upper portion 418. The semiannular lower portion of the outer surface has a diameter of approximately 19.2 millimeters. The rectangular upper portion has a width of approximately 19.2 millimeters and a height of approximately 9.6 millimeters. The winding loop includes a lower gap 420 from the inner surface to the outer surface. The gap has a width of approximately 3.5 millimeters. The gap is sized to accommodate the widths of the upper bridge 360 and the lower bridge 362 of the bobbin tube 300.

An upper portion of the inner surface 412 of the winding loop 410 includes an arcuate recessed portion 430 having a width of approximately 3.5 millimeters and having a radial depth of approximately 0.25 millimeters. The arcuate recessed portion is configured to fit onto the upper bridge 360 of the bobbin tube 300.

A first connector stub 440 and a second connector stub 442 extend vertically downward (as viewed in FIG. 18) from the winding loop 410. The first connector stub (on the left as viewed in FIG. 18) has an inner lateral surface 450 that extends downward from the counterclockwise termination of the inner surface 412 of the winding loop and has an outer lateral surface 452 that extends vertically downward from the counterclockwise termination of the outer surface 414. The second connector stub (on the right as viewed in FIG. 18) has an inner lateral surface 454 that extends downward from the clockwise termination of the inner surface of the winding loop and has an outer lateral surface 456 that extends vertically downward from the clockwise termination of the outer surface. In the illustrated embodiment, the two inner lateral surfaces are spaced apart by approximately 3.5 millimeters, which enables the two inner lateral surfaces to be positioned on opposite sides of the lower bridge 362 of the bobbin tube 300. The respective outer lateral surfaces are spaced apart from the respective inner lateral surfaces by approximately 3.5 millimeters to form the upper width of each connector stub.

The inner lateral surface 450 of the first connector stub 440 extends vertically downward for approximately 8.1 millimeters from the inner surface 412 of the winding loop 410. The outer lateral surface 452 of the first connector stub extends vertically downward for approximately 6 millimeters from the outer surface 414 of the winding loop. The two lateral surfaces are spaced apart by approximately 3.5 millimeters. A lower surface 460 of the first connector stub includes a notch 462 having a width of approximately 1.5 millimeters and a vertical depth of approximately 3 millimeters. The material on either side of the notch forms a first connection prong 464 and a second connection prong 466. Each connection prong has a width of approximately 1 millimeter. In other embodiments, the notch can be omitted such that the two connection prongs at the end of each connector stub are replaced with a single connection prong.

The inner lateral surface 454 of the second connector stub 442 extends vertically downward for approximately 5.1 millimeters. The inner lateral surface then extends horizontally away from the first connector stub 440 for approximately 4.25 millimeters and then extends vertically downward for approximately 3 millimeters. The outer lateral surface of the second connector stub extends vertically downward for approximately 1 millimeter and is spaced apart from the inner lateral surface by approximately 3.5 millimeters. The outer lateral surface than extends horizontally way from the inner lateral surface for approximately 4.3 millimeters and then extends vertically downward for approximately 5 millimeters. A lower surface 470 of the second connector stub is aligned with the lower surface 440 of the first connector stub. The lower surface of the second connector stub includes a notch 472 having a width of approximately 1.5 millimeters and a vertical depth of approximately 3 millimeters. The material on either side of the notch forms a first connection prong 474 and a second connection prong 476 of the second connector stub. Each connection prong has a width of approximately 1 millimeter. The two prongs and the notch have a total width of approximately 3.5 millimeters.

The second conductive sheet 392 is identical to the first conductive sheet 372; however, as shown in FIG. 18, the second conductive sheet is rotated about a vertical axis with respect to the first conductive sheet such that the first connector stub 420 of the second conductive sheet is on the left instead of the right and such that the second connector stub 422 of the second conductive sheet is on the right instead of the left.

Figure 21:
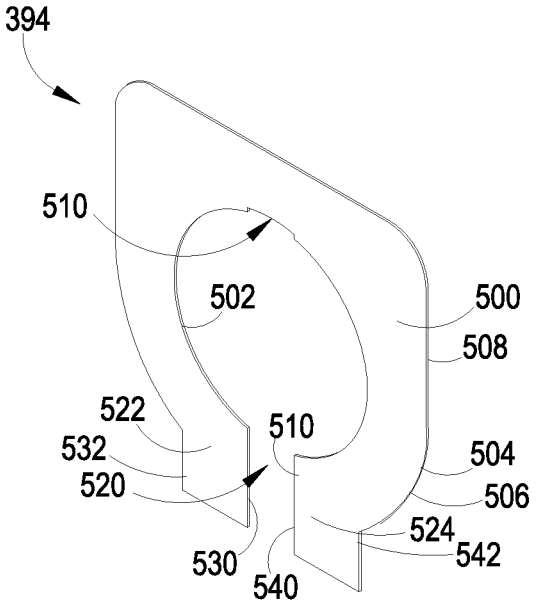
FIG. 21 illustrates an upper front perspective view of the insulating sheet of FIG. 18.

As illustrated in FIG. 21, the insulating sheet 394 comprises an insulating loop 500, which has a shape similar to the shape to the winding loop 410 of the first conductive sheet 390 and the second conductive sheet 392; however, the insulating loop of the insulating sheet has slightly smaller inner dimensions and slightly larger outer dimensions such that the insulating sheet completely isolates the overlapping portions of the first conductive sheet and the second conductive sheet. For example, in one embodiment, the insulating loop has an inner surface 502, which has a diameter of approximately 12.05 millimeters. The insulating loop has an outer curved surface 504, which has a semiannular lower portion 506 and a generally rectangular upper portion 508. The lower portion has a diameter of approximately 19.35 millimeters. The upper portion has a width of approximately 19.35 millimeters and has a height of approximately 9.68 millimeters. The inner surface of the insulating loop has an arcuate recessed portion 510, which has a radial depth of approximately 0.22 millimeter and has a transverse width of approximately 2.92 millimeters. The insulating sheet has a front surface 512 and a rear surface 514. As shown in FIG. 18, a centerline 516 passes through the insulating sheet in a vertical direction (as viewed in FIG. 18).

A gap 520 is formed in the lower portion of the insulating loop 500. In the illustrated embodiment, the gap has a width of approximately 2.94 millimeters. A first insulating stub 522 and a second insulating stub 524 extend vertically downward (as viewed in FIG. 21) from the insulating loop on the left side and the right side, respectively, of the gap. The first insulating stub has an inner lateral surface 530 that extends downward from the counterclockwise termination of the inner surface 502 of the insulating loop 500 and has an outer lateral surface 532 that extends vertically downward from the counterclockwise termination of the outer surface 504. The second insulating stub has an inner lateral surface 540 that extends downward from the counterclockwise termination of the inner surface of the insulating loop and has an outer lateral surface 542 that extends vertically downward from the counterclockwise termination of the outer surface of the insulating loop. The two inner lateral surfaces are spaced apart by the gap, which enables the two inner lateral surfaces to clear the upper bridge 360 of the bobbin tube and to be positioned on opposite sides of the lower bridge 362 of the bobbin tube. The respective outer lateral surfaces are spaced apart from the respective inner lateral surfaces by approximately 4 millimeters to form the width of each insulating stub. The width of the insulating stubs is selected to be greater than the width of the winding stubs described above.

The inner lateral surface 530 of the first insulating stub 522 extends vertically downward for approximately 5.35 millimeters from the counterclockwise termination of the inner surface 502 of the insulating loop 500. The outer lateral surface 532 of the first insulating stub extends vertically downward for approximately 3.25 millimeters from the counterclockwise termination of the outer surface 504 of the insulating loop. The inner lateral surface 540 and the outer lateral surface 542 of the second insulating stub 524 have corresponding dimensions such that the second insulating stub mirrors the first insulating stub.

Figure 16:
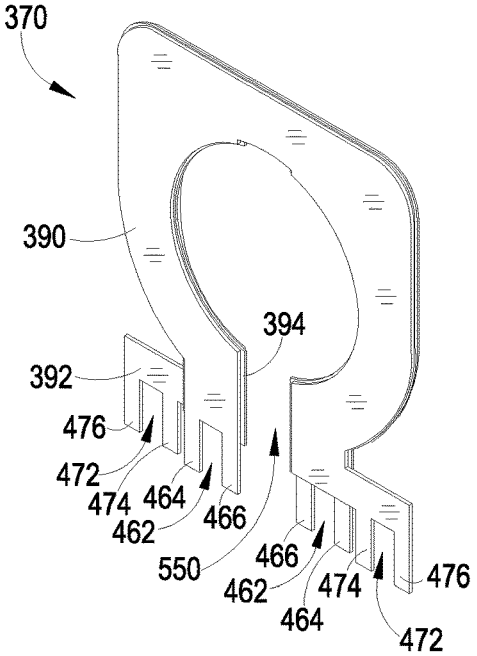
FIG. 16 illustrates an upper front perspective view of one of the winding inserts of FIGS. 12-15.
Figure 17:
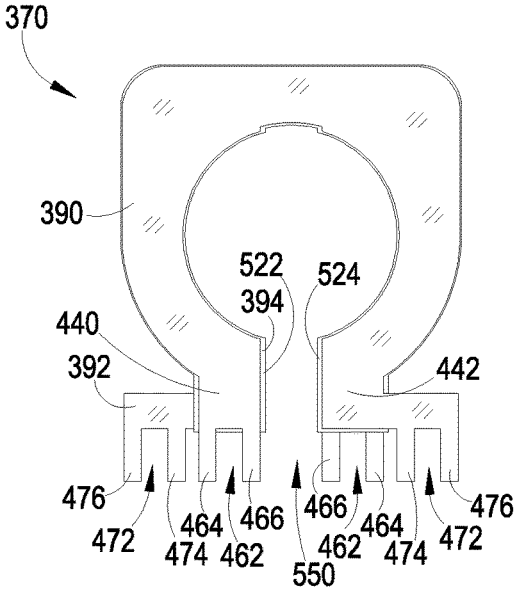
FIG. 17 illustrates a front plane view of the winding insert of FIG. 16.

As shown in FIGS. 16-18, when the first conductive sheet 390, the second conductive sheet 392 and the insulating sheet 394 are assembled to form the winding inner surfaces of the loops of the three sheets are concentric about a longitudinal axis 548. The second (rear) surface 402 of the first conductive sheet abuts the first surface 512 of the insulating sheet. As further shown in FIGS. 16-18, the second conductive sheet is flipped about the centerline 404 with respect to the first conductive sheet such that the second (rear) surface 402 of the second conductive sheet abuts the second surface 514 of the insulating sheet. When positioned as shown, first connection prong 474 and the second connection prong 476 of the second connector stub 442 of the second conductive sheet 392 are positioned laterally to the left of the first connection prong 464 and the second connection prong 466 of first connector stub 460 of the first conductive sheet 390 on the left side of the centerline 516 of the insulating sheet. Similarly, the first connection prong 474 and the second connection prong 476 of the second connector stub 442 of the first conductive sheet 390 are positioned laterally to the right of the first connection prong 464 and the second connection prong 466 of first connector stub 440 of the second conductive sheet 392 on the right side of the centerline 516 of the insulating sheet. Accordingly, the connection prongs of the two conductive sheets cannot be bent or otherwise caused to contact each other. As further shown in FIG. 17, the lower ends of the first insulating stub 522 and the second insulating stub 524 of the insulating sheet 394 terminate just below the upper ends of the notches 462 that separate the connection prongs of the first connector stubs of each conductive sheet. Thus, the insulating sheet prevents any electrical connector between the adjacent portions of the two conductive sheets. The assembled winding insert has an insert gap 550, which is created by the alignment of the gaps 470 of the first conductive sheet and the second conductive sheet and the gap 520 of the insulating sheet. The insert gap enables the winding insert to be inserted on both sides of the upper bridge 360 and the lower bridge 362 of the bobbin 110.

Figure 14:
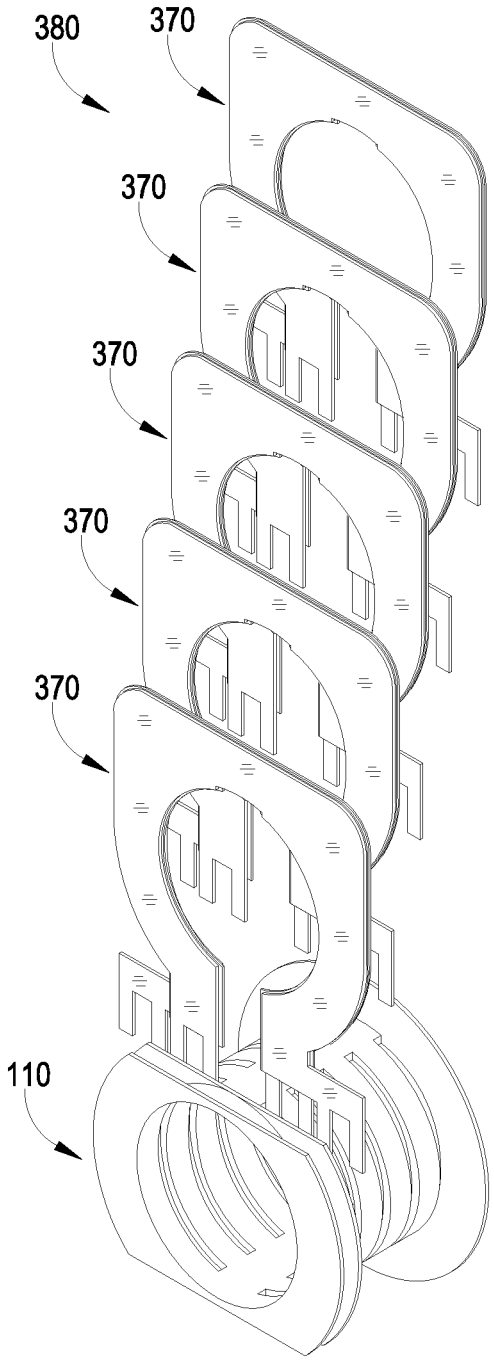
FIG. 14 illustrates an exploded upper front perspective view of the bobbin and winding inserts of FIG. 12.
Figure 15:
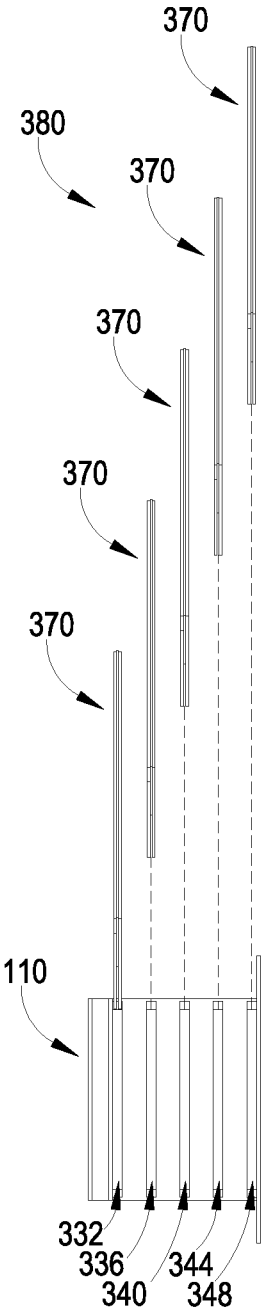
FIG. 15 illustrates a right elevational view of the bobbin and winding inserts of FIG. 12 with the winding inserts shown in the exploded positions of FIG. 14.

When the winding insert 370 is assembled as shown in FIG. 16, the three layers of the winding insert have an overall thickness of approximately 0.527 millimeter, which is slightly less than the width of each of the slots 320 through 338 of the bobbin 110. As discussed above, each slot has a width of approximately 0.64 millimeter. Thus, each winding insert is insertable into a respective pair of slots as shown in FIGS. 14 and 15.

The connection prongs 464, 466, 474, 476 of the winding inserts 370 are insertable into electrical interconnection holes in a printed circuit board (discussed below with respect to FIG. 38) when the magnetic component 100 is fully assembled. The interconnection holes may be electrically interconnected in a variety of configurations to electrically interconnect the winding loops 410 of the conductive sheets 390, 392 in series, in parallel, or in series-parallel combinations.

The winding inserts 370 provide at least two functions. The first conductive sheet 390 and the second conductive sheet 392 of each winding insert corresponds to one partial turn of a winding. As described below, the connection prongs 464, 466, 474, 476 of the conductive sheets can be interconnected in various ways to connect the partial turns in series, in parallel, or in a series-parallel combination to provide one or more windings. The winding inserts also function as winding guides for a coil wound onto the bobbins as shown in FIGS. 22-31.

Figure 22:
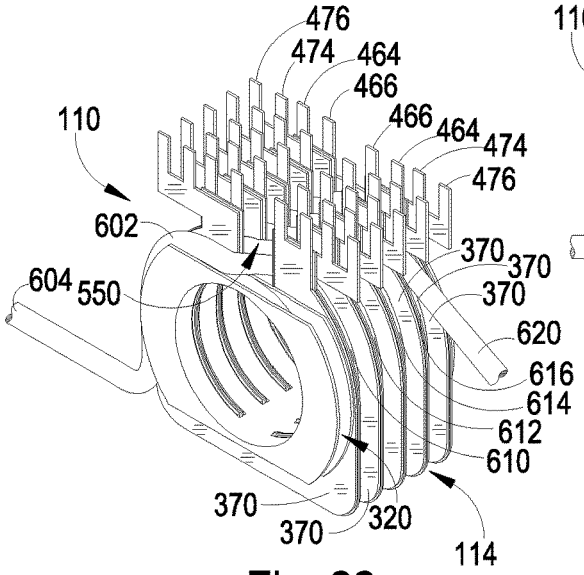
FIG. 22 illustrates an upper front view of the first bobbin of FIG. 1 with a first layer of a coil wound thereon, the first bobbin of FIG. 22 rotated 180 degrees about the longitudinal axis from the view in FIG. 12 such that the connection prongs are facing upward as shown in FIG. 1.
Figure 23:
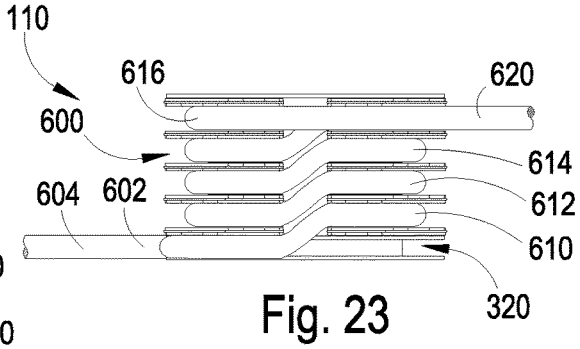
FIG. 23 illustrates a top plan view of the first bobbin and the first winding layer of FIG. 22, the view showing the passage of the wire through the insert slots of the winding inserts between adjacent turns of the first layer of the first coil.
Figure 24:
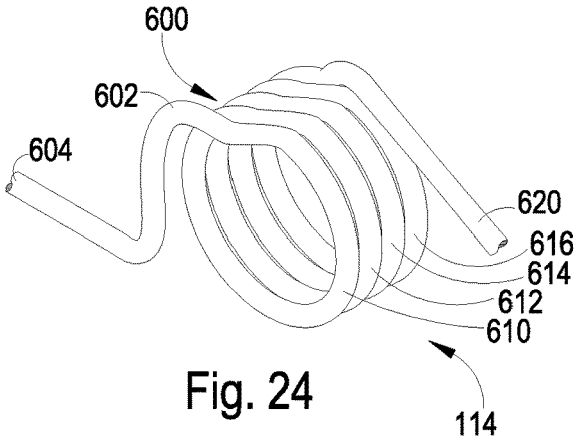
FIG. 24 illustrates an upper front perspective view of the first layer of the coil of FIG. 22, the view further showing portions of the first layer of the coil that are hidden in the view of FIG. 22.

FIGS. 22-24 illustrate the first bobbin 110 with a first (inner) layer 600 of a wire 602 forming the first coil 114 wound thereon in a clockwise winding direction from the front of the bobbin to the rear of the bobbin. The first bobbin is positioned with the connection prongs 464, 466, 474, 476 (FIGS. 16-17) facing upward. The wire of the first layer has an input section 604, which is guided onto the bobbin by the annular wire guide 320. The wire passes through the insert gap 550 (FIGS. 16-17) of the first winding insert 370 and is wound around the bobbin tube 300 in the space between the first winding insert and the second winding insert to form a first inner turn 610. The wire then passes through the insert gap of the second winding insert and is wound around the bobbin tube in the space between the second winding insert and the third winding insert to form a second inner turn 612. The wire then passes through the insert gap of the third winding insert and is wound around the bobbin tube in the space between the third winding insert and the fourth winding insert to form a third inner turn 614. The wire then passes through the insert gap of the fourth winding insert and is wound around the bobbin tube in the space between the fourth winding insert and the fifth winding insert to form a fourth inner turn 616. A truncated portion 620 of the wire is shown prior to forming a second (outer) layer 630 of the first coil.

Figure 25:
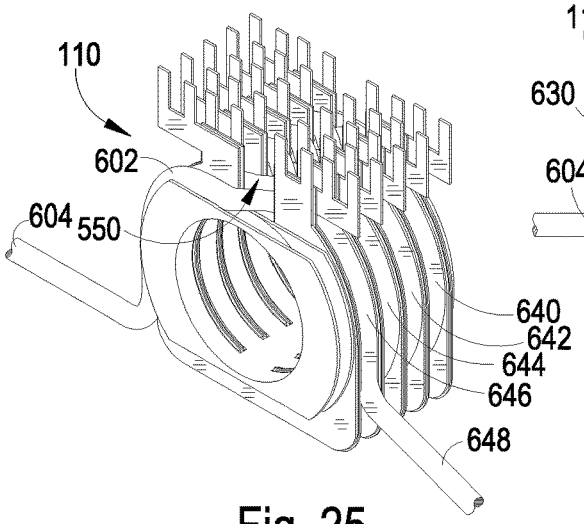
FIG. 25 illustrates an upper front perspective view of the first bobbin of FIG. 22 with a second layer of the first coil wound over the first layer of FIGS. 22-24.
Figure 26:
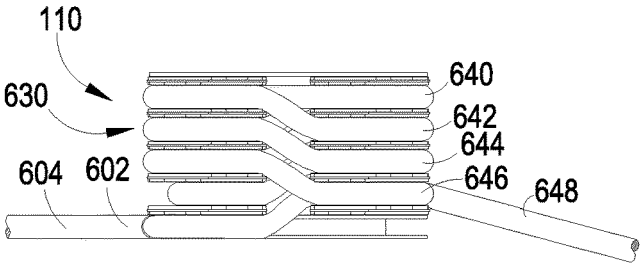
FIG. 26 illustrates a top plan view of the first bobbin and the first and second winding layers of the first coil of FIG. 25 showing the passage of the wire through the insert slots of the winding inserts between adjacent turns of the second layer of the first coil.
Figure 27:
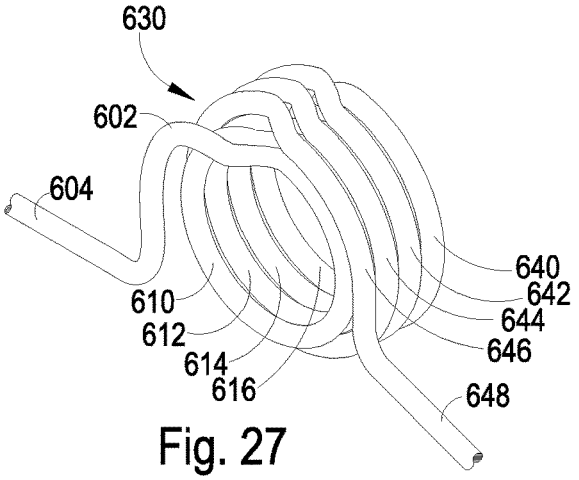
FIG. 27 illustrates an upper front perspective view of the first and second layers of the first coil of FIG. 22, the view further showing portions of the first and second layers of the first coil that are hidden in the view of FIG. 25.

As shown in FIGS. 25-27, the second (outer) layer 630 of the first coil 114 is formed on the first bobbin 110 by continuing to wind the wire 602 clockwise from the rear of the bobbin to the front of the bobbin. A first outer turn 640 of the wire is wound over the fourth inner turn 616 between the fifth winding insert 370 and the fourth winding insert. The wire passes through the insert gap 550 in the fourth insert and is wound over the third inner turn 614 between the fourth winding insert and the third winding insert to form a second outer turn 642. The wire passes through the insert gap in the third insert and is wound over the second inner turn 612 between the third winding insert and the second winding insert to form a third outer turn 644. The wire passes through the insert gap in the second insert and is wound over approximately one-fourth of the first inner turn 610 to form a partial fourth outer turn 646. A truncated section 648 of the wire represents the beginning of the wire wound onto the second bobbin 112, as described below. In the illustrated embodiment, the space between adjacent winding turns is selected to be slightly greater than the diameter of the wire such that each outer winding turn is positioned directly over the inner winding turn to provide controlled alignment of the turns.

FIGS. 28-31 illustrate the second bobbin 112 with a first (inner) layer 700 of the wire 602 forming the second coil 116 wound thereon in a counterclockwise direction from the front of the bobbin to the rear of the bobbin. In the illustrated embodiment, the wire is shown as a continuous wire that is first wound on the first bobbin 110 and is then wound on the second bobbin. In other embodiments, the second bobbin can be wound with a separate wire, as described below, and then the windings of the two bobbins can be interconnected by soldering or other suitable interconnection techniques.

Figure 28:
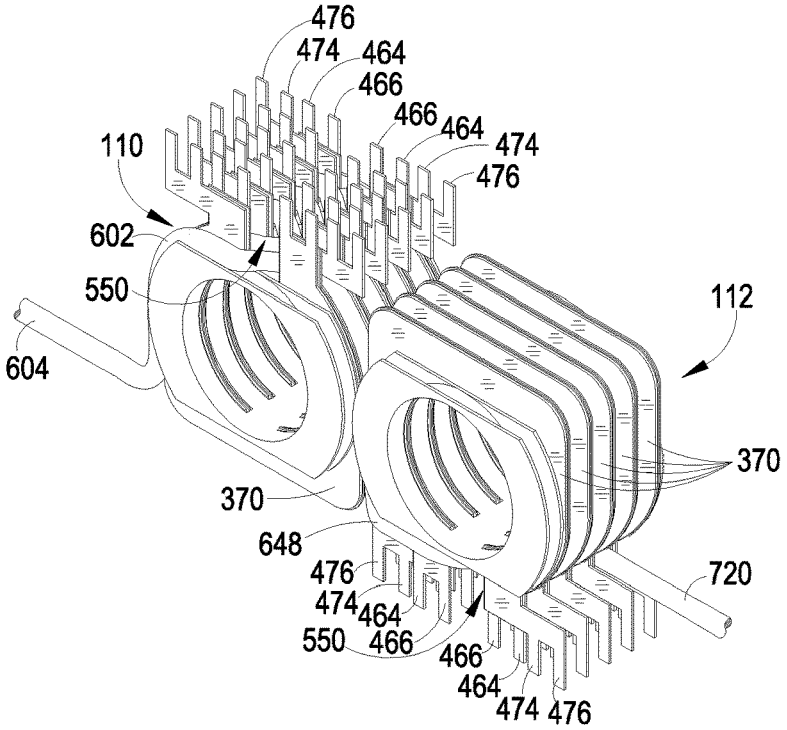
FIG. 28 illustrates an upper front perspective view of the first and second bobbins of FIG. 1 with the first bobbin positioned with the connection prongs directed upward and with connection prongs of the second bobbin facing downward, the first bobbin having the first and second layers of the first coil wound thereon, the second bobbin having a first layer of the second coil wound thereon.
Figure 29:
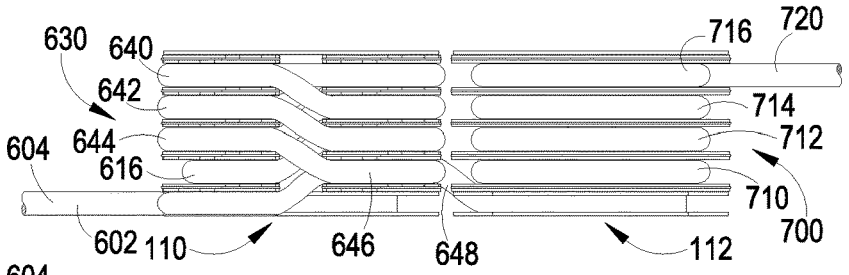
FIG. 29 illustrates a top plan view of the first and second bobbins of FIG. 28 with the first and second layers of the first coil wound on the first bobbin and with the first layer of the second coil wound on the second bobbin.
Figure 30:
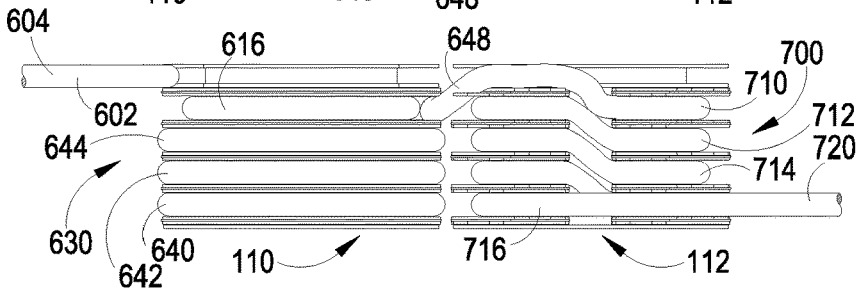
FIG. 30 illustrates a bottom plan view of the first and second bobbins of FIG. 28, the view showing the passage of the wire through the insert slots of the winding inserts between adjacent turns of the second coil.

As shown in FIGS. 28-30, the second bobbin 112 is rotated about the longitudinal axis 306 (FIGS. 8-9) with respect to the first bobbin 110 such that the connection prongs 464, 466, 474, 476 face downward in the opposite direction from the connection prongs of the first bobbin. The two bobbins are positioned side-by-side in FIGS. 28-30; however, the second bobbin can also be rotated around a vertical axis with respect to the first bobbin to separate the two bobbins during the winding process.

Figure 31:
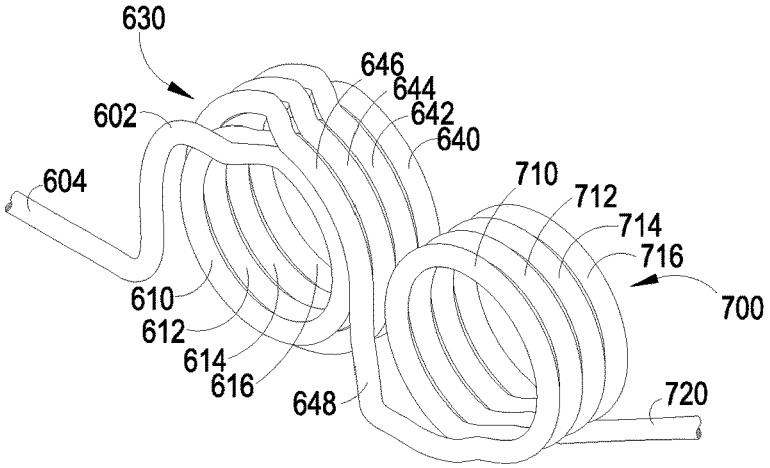
FIG. 31 illustrates an upper front perspective view of the first and second layers of the first coil of and the first layer of the second coil of FIG. 28, the view further showing portions of the layers of the first and second coils that are hidden in the view of FIG. 28.
Figure 32:
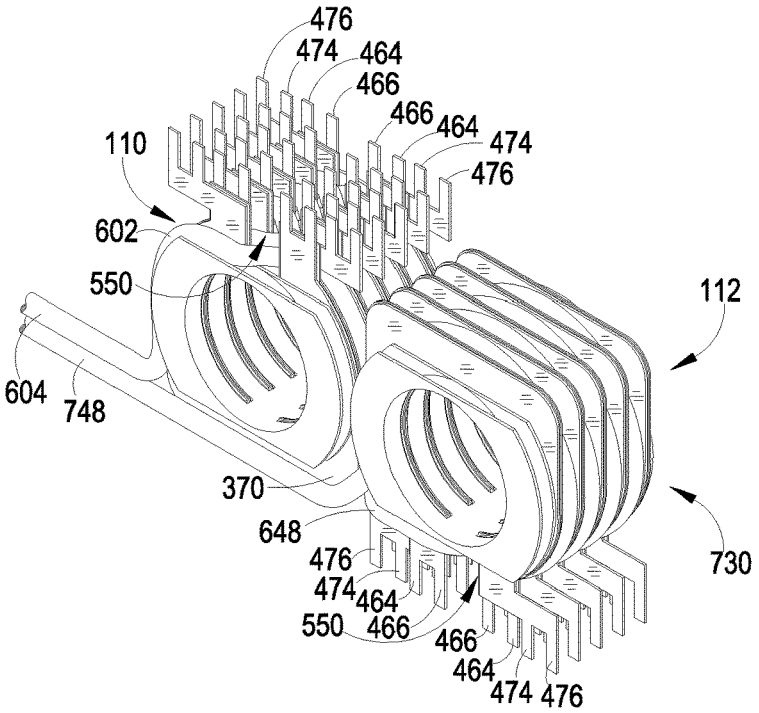
FIG. 32 illustrates an upper front perspective view of the first bobbin and the second bobbin of FIG. 28 with a second layer of the second coil wound over the first layer of the second coil shown in FIGS. 28-31.
Figure 33:
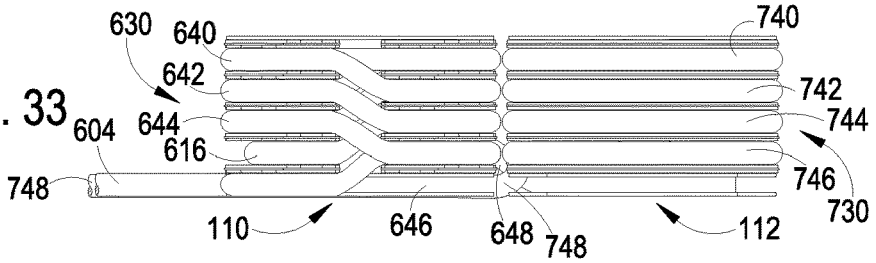
FIG. 33 illustrates a top plan view of the first and second bobbins of FIG. 32 with the first and second layers of the first coil wound on the first bobbin and with the first and second layers of the second coil wound on the second bobbin.
Figure 34:
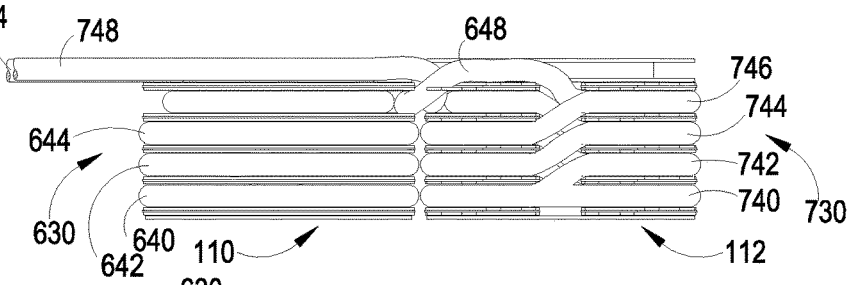
FIG. 34 illustrates a bottom plan view of the first and second bobbins of FIG. 32, the view showing the passage of the wire through the insert slots of the winding inserts between adjacent turns of the second layer of the second coil.
Figure 35:
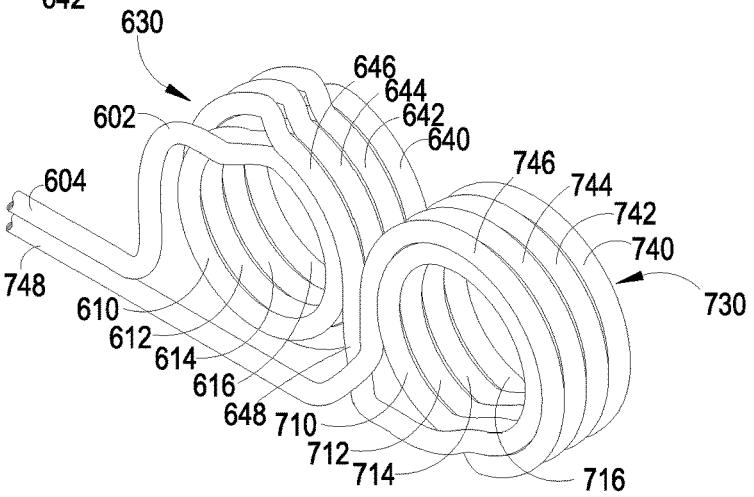
FIG. 35 illustrates an upper front perspective view of the first and second layers of the first coil of and the first and second layers of the second coil of FIG. 32, the view further showing portions of the layers of the first and second coils that are hidden in the view of FIG. 32.

A first layer 700 of the second coil 116 is wound onto the second bobbin 112 by passing the wire 602 between the insert gap 550 (FIGS. 16-17) of the first winding insert 370 and is wound counterclockwise around the bobbin tube 300 in the space between the first winding insert and the second winding insert to form a first inner turn 710. The wire then passes through the insert gap of the second winding insert and is wound around the bobbin tube in the space between the second winding insert and the third winding insert to form a second inner turn 712. The wire then passes through the insert gap of the third winding insert and is wound around the bobbin tube in the space between the third winding insert and the fourth winding insert to form a third inner turn 714. The wire then passes through the insert gap of the fourth winding insert and is wound around the bobbin tube in the space between the fourth winding insert and the fifth winding insert to form a fourth inner turn 716. A truncated portion 720 of the wire is shown prior to forming a second (outer) layer 730 of the second coil. The inner turns are hidden by the winding inserts in FIG. 28. The inner turns are shown in FIGS. 29-31.

As shown in FIGS. 32-35, the second (outer) layer 730 of the second coil 116 is formed on the second bobbin 112 by continuing to wind the wire 602 counterclockwise from the rear of the bobbin to the front of the bobbin. A first outer turn 740 of the wire is wound over the fourth inner turn 716 between the fifth winding insert 370 and the fourth winding insert. The wire passes through the insert gap 550 in the fourth insert and is wound over the third inner turn 714 between the fourth winding insert and the third winding insert to form a second outer turn 742. The wire passes through the insert gap in the third insert and is wound over the second inner turn 712 between the third winding insert and the second winding insert to form a third outer turn 744. The wire passes through the insert gap in the second insert and is wound over approximately three-fourths of the first inner turn 710 to form a partial fourth outer turn 746. A section 748 of the wire continues from the end of the partial fourth outer turn as the output of the second coil.

Figure 36:
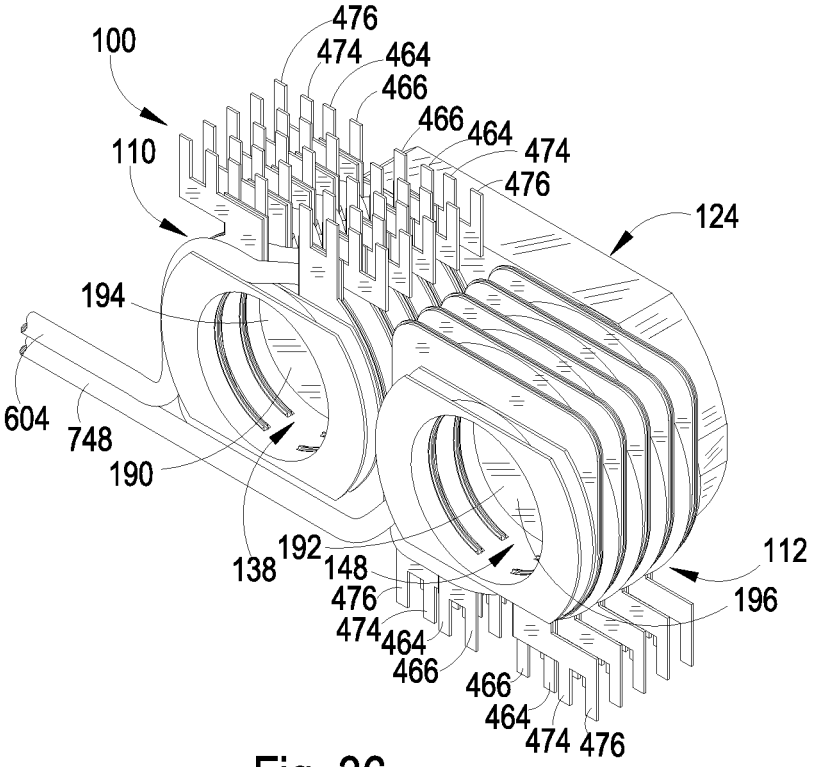
FIG. 36 illustrates an upper front perspective view of the bobbins and coils of FIG. 32 with the core legs of the second core half of FIG. 3 inserted into the core-receiving passageways of the first and second bobbins from the rear of each of the two bobbins.

After the first coil 114 and the second coil 116 are wound onto the respective first bobbin 110 and second bobbin, the core-receiving passageways 138 of the two bobbins are inserted onto the first core leg 190 and the second core leg 192 of the second core half 124 as shown in FIG. 36. The first core leg 170 and the second core leg 172 of the first core half 122 are then inserted into the core-receiving passageways of the bobbins from the opposite ends of the core-receiving passageways to form the complete magnetic assembly shown in FIG. 37. In the illustrated embodiment, the order in which the first and second core halves are coupled to the first and second bobbins can be reversed. As discussed above, the core legs are spaced apart laterally by a sufficient distance that the first and second bobbins can be positioned on the core legs in a spaced apart relationship such that the two bobbins, including the winding inserts 370 and the coils 114, 116 do not interfere with each other. For example, in one embodiment, the centers of the legs are spaced apart by approximately 20 millimeters such that the innermost edges of the insulating sheets 394 of the winding inserts are spaced apart by approximately 0.65 millimeter. The centers of the legs can be spaced farther apart to accommodate larger winding inserts or spaced apart by less distance if winding inserts are smaller.

Figure 37:
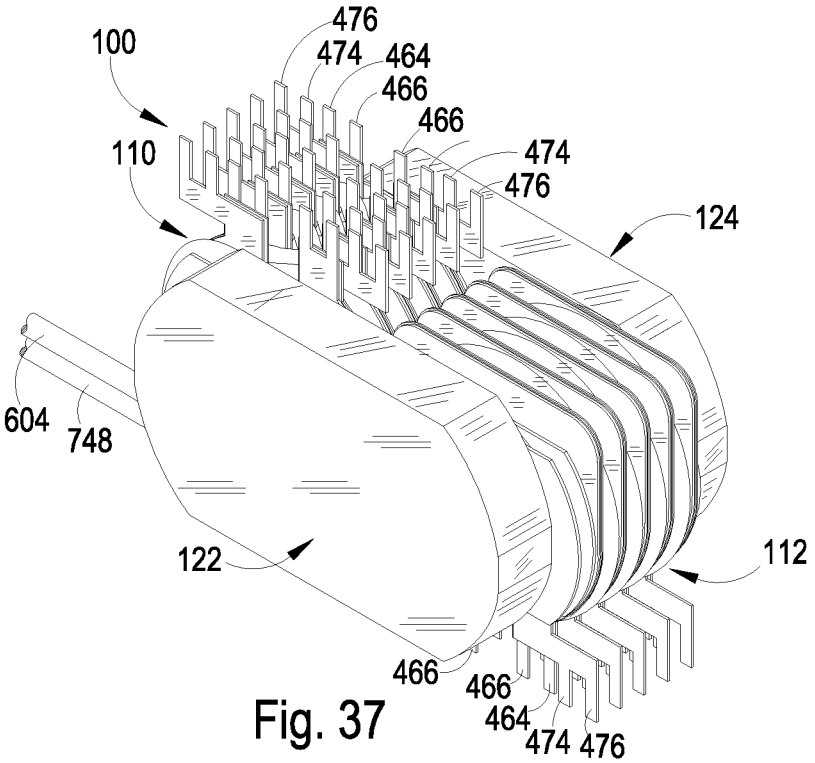
FIG. 37 illustrates an upper front perspective view of the bobbins and coils of FIG. 36 with the core legs of the first core half of FIG. 3 inserted into the core-receiving passageways of the first and second bobbins from the front of each of the two bobbins.

As discussed above, in the illustrated embodiment, the connection prongs 464, 466, 474, 476 of the first bobbin face in a first direction (upward in FIGS. 36 and 37); and the connection prongs of the second bobbin face in an opposite direction (downward in FIGS. 36 and 37). In other embodiments (not shown), the connection prongs of both bobbins can face in the same direction.

Figure 38:
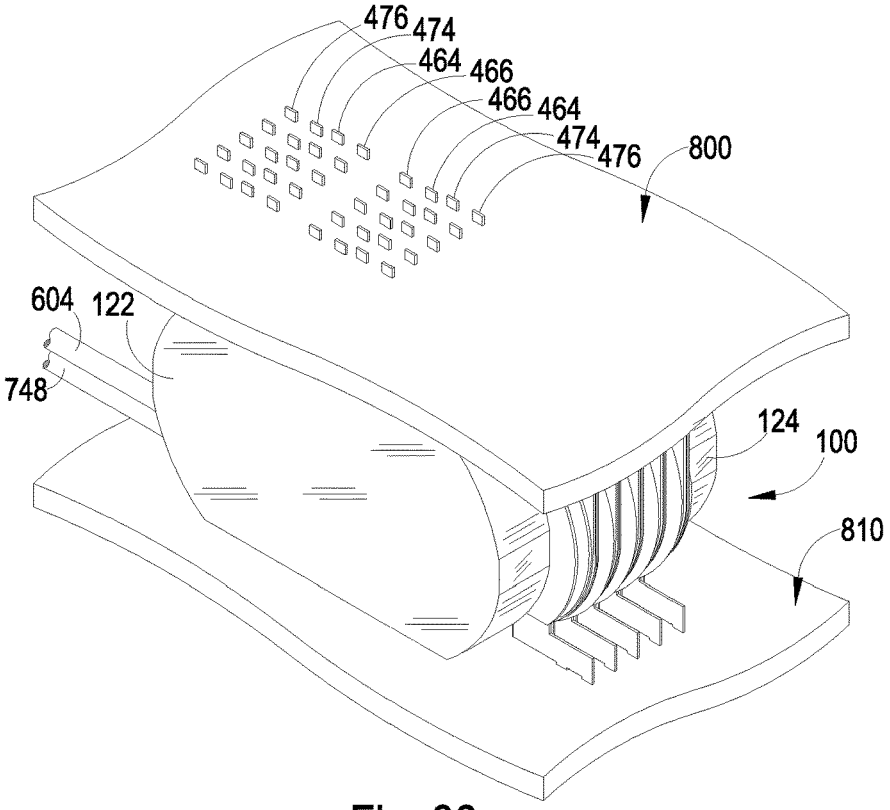
FIG. 38 illustrates an upper front perspective view of the assembled bobbins, coils and core halves of FIG. 37 with the connector prongs of first bobbin inserted into slots of an upper printed circuit board and with the connector prongs of the second bobbin inserted into a lower printed circuit board.

The positioning of the connection prongs 464, 466, 474, 476 as shown in FIGS. 36-37 enables the magnetic assembly 100 to be used to provide power or signals to a first (upper) printed circuit board (PCB1) 800 and to a second (lower) printed circuit board (PCB2) 810 as shown in FIG. 38. The connection prongs of the first bobbin 110 (see FIG. 32) are electrically connected to the first printed circuit board. The connection prongs of the second bobbin 112 are electrically connected to the second printed circuit board.

In FIG. 38, the first printed circuit board 800 and the second printed circuit board 810 are parallel. The two printed circuit boards can also be oriented perpendicular to each other by rotating one of the first bobbin 110 and the second bobbin 112 90 degrees from the position shown in the illustrated embodiment such that the connection prongs 464, 466, 474, 476 of the rotated bobbin are directed laterally outward.

Figure 39:
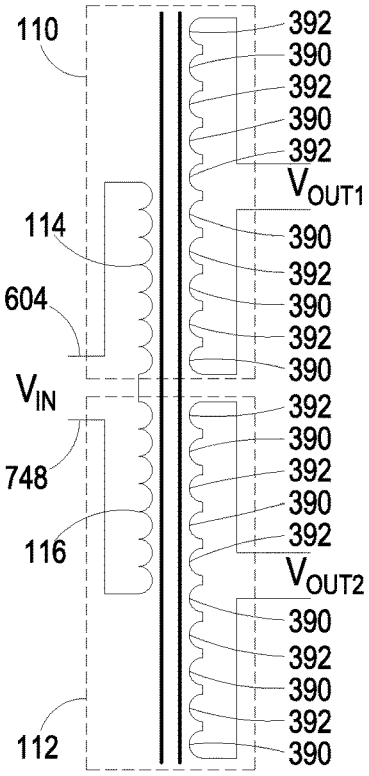
FIG. 39 illustrates an electrical diagram of a first configuration of serially interconnected connector prongs on each of the two printed circuit boards of FIG. 38 that provides a respective first output voltage to the first printed circuit board and that provides a respective second output voltage to the second printed circuit board.

The printed wiring patterns (not shown) on the two printed circuit boards interconnect the connection prongs 464, 466, 474, 476 of the first bobbin 110 and the second bobbin 112 to determine the configuration of the windings provided by the winding inserts 370. For example, FIG. 39 illustrates a first winding configuration 820 in which the ten conductive sheets 390 of the winding inserts of the first bobbin are connected in series to provide a first single output voltage ($V_{OUT1}$) to the first printed circuit board 800. Similarly, the ten conductive sheets of the winding inserts of the second bobbin are connected in series to provide a second single output voltage ($V_{OUT2}$) to the second printed circuit board 810. The output voltages are generated in response to an input voltage ($V_{IN}$) applied to the first coil 114 and the second coil 116, which are effectively connected in series on the primary side of the magnetic component 100. It should be understood that winding the first coil of the first bobbin 110 in the clockwise direction and winding the second coil of the second bobbin 112 in the counterclockwise direction causes the magnetic fields produced by the two coils to be in the same direction around the magnetic path formed by the first core half 120 and the second core half 122.

Figure 40:
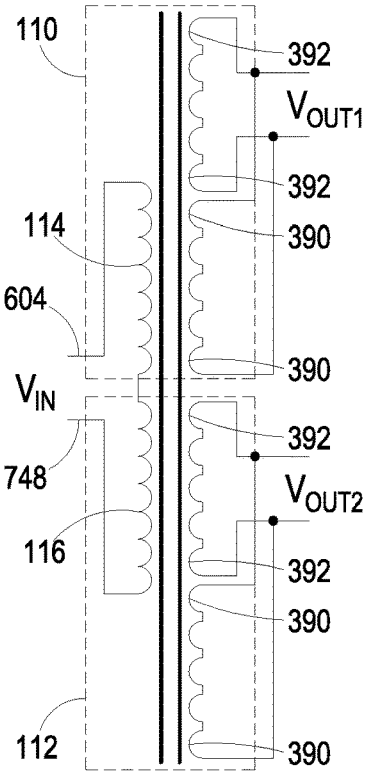
FIG. 40 illustrates an electrical diagram of a second configuration of connector prongs interconnected as two series circuits in parallel on each of the two printed circuit boards of FIG. 38 that provides a respective first output voltage to the first printed circuit board and that provides a respective second output voltage to the second printed circuit board.

FIG. 40 illustrates an alternative configuration 830 of the printed wiring patterns (now shown) on the printed circuit boards 800, 810 in which the printed wiring patterns on each printed circuit board interconnects a first set of five conductive sheets 390 in series and interconnects a second set of five conductive sheets in series. The printed wiring patterns interconnects the two sets of series-connected conductive sheets in parallel to provide the first single output voltage ($V_{OUT1}$) to the first printed circuit board and to provide the second single output voltage ($V_{OUT2}$) to the second printed circuit board. If the input voltage ($V_{IN}$) remains the same as before, the two output voltages provided by the series-parallel configuration of FIG. 40 are one-half the previous output voltages and the current capacity will be doubled.

Figure 41:
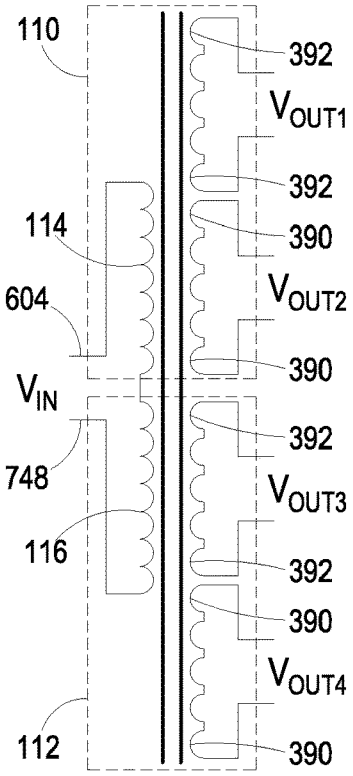
FIG. 41 illustrates an electrical diagram of a third configuration of connector prongs interconnected as two independent series circuit on each of the two printed circuit boards of FIG. 38 to provides a first output voltage and a second output voltage to the first printed circuit board and that provides a third output voltage and a fourth output voltage to the second printed circuit board.

The printed wiring configurations of the two printed circuit boards 800, 810 do not have to be the same. For example, one printed circuit board can have the series configuration shown in FIG. 39 and the other printed circuit board can have the series-parallel configuration shown in FIG. 40. Other printed wiring configurations can also be implemented. For example, FIG. 41 illustrates a configuration 840 in which the conductive sheets 370 are interconnected as two sets of five conductive sheets in series for each of the bobbins 110, 112. In FIG. 41, each set of five conductive sheets provides an output voltage such that a first voltage ($V_{OUT1}$) and a second output voltage ($V_{OUT2}$) are provided to the first printed circuit board 800 and a third voltage ($V_{OUT3}$) and a fourth voltage ($V_{OUT4}$) are provided to the second printed circuit board 810. In a further configuration (not shown) two voltages can be provided to one printed circuit board and a single voltage (either series or series-parallel) can be provided to the other printed circuit board. Access to the connection prongs 464, 466, 474, 476 enables the conductive sheets to be interconnected on each printed circuit board in many different configurations. For example, the connection prongs can also be interconnected to provide more than two parallel windings to one or both printed circuit boards.

In the illustrated embodiments, the primary winding comprising the first coil 114 and the second coil 116 are illustrated as a single continuous winding on the first bobbin 110 and the second bobbin 112. In alternative embodiments, the two windings may be separated (e.g., not connected between the two bobbins) such that the respective first ends and the respective second ends of the windings can be connected together to configure the first and second windings in parallel. In further alternative embodiments, the two bobbins may be wound with smaller wires such that two or more windings may be wound in parallel on the two bobbins.

Figure 42:
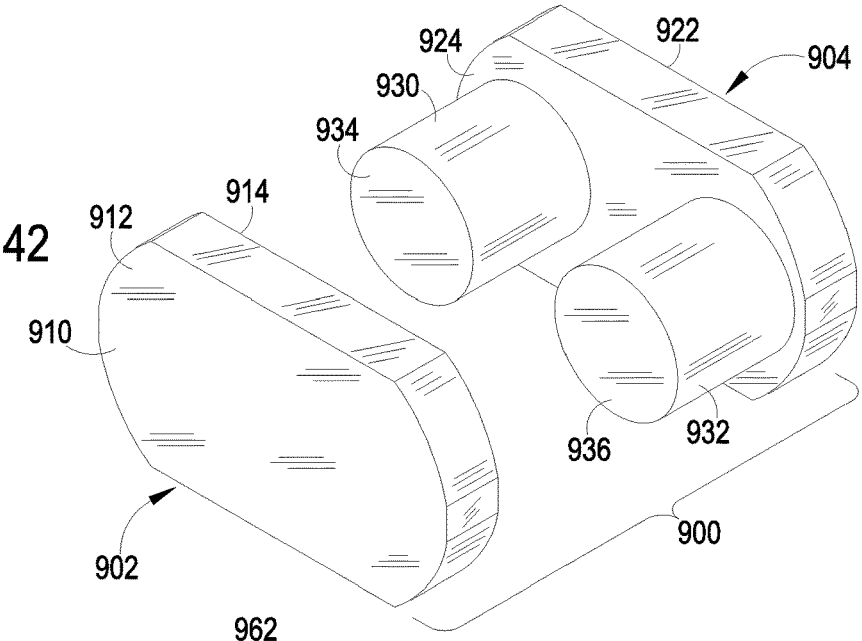
FIG. 42 illustrates an alternative core structure in which the two symmetrical core halves are replaced with a first core section with longer legs than in the previously described embodiment and a second core section having a core body with no core legs.

The magnetic core 120 of the magnetic component can be replaced with core structures having different configurations. FIG. 42 illustrates a core structure 900 having a first core section 902 and a second core section 904. The first core section comprises a core body 910 only, which has a size and shape corresponding to the size and shape of the previously described core bodies. The core body of the first section has an outer surface 912 and an inner surface 914. Unlike the previously described core bodies, the core body in FIG. 42 does not have legs extending from the inner surface. The second core section has a core body 920, which has an outer surface 922 and an inner surface 924. A first core leg 930 and a second core leg extend from the inner surface of the core body of the second core section. The first core leg has an end surface 934. The second core leg has an end surface 936. After the first and second bobbins 110, 114 are installed on the first and second core legs of the second core section, the inner surface of the core body of the first core section is positioned adjacent to the end surfaces of the first and second core leg. The end surfaces of the first and second core legs can abut the inner surface of the core body of the first core section and can be attached thereto by a suitable adhesive. If the first and second core legs are shorter than the core-receiving passageways 138, 148 of the first and second bobbins, a gap is formed between the end surfaces of the core legs and the inner surface of the core body of the first core section. The first core section and the second core section are maintained in a juxtaposed relationship by tape or other suitable fastening devices.

Figure 43:
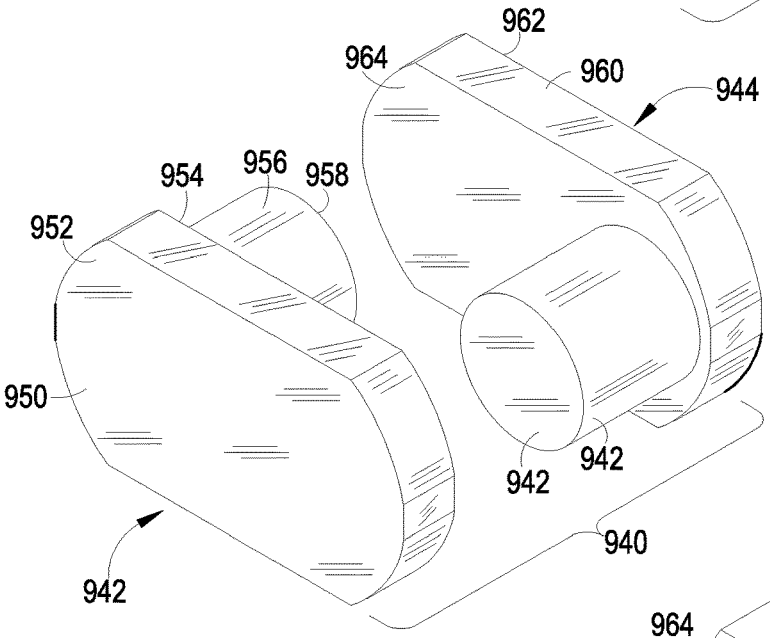
FIG. 43 illustrates an alternative core structure with two symmetrical core halves, wherein in each core half comprises only a single core leg.

FIG. 43 illustrates a further alternative core structure 940 having a first core section 942 and a second core section 944. The first core section comprises a core body 950, which has a size and shape corresponding to the size and shape of the previously described core bodies. The core body of the first section has an outer surface 952 and an inner surface 954. A first core leg 956 extends from the inner surface of the core body of the first core section to an end surface 958. The second core section has a core body 960, which has an outer surface 962 and an inner surface 964. A second core leg 966 extends from the inner surface of the core body of the second core section to an end surface 968. The first and second bobbins 110, 114 are installed on the first and second core legs by inserting the first core leg of the first core section into the core receiving passageway 138 of the first bobbin from the front of the first bobbin and by inserting the second core leg of the second core section into the core-receiving passageway of the second bobbin from the rear of the second bobbin. The end surfaces of the first and second core legs can abut the inner surfaces of the opposing core body and can be attached thereto by a suitable adhesive. If the first and second core legs are shorter than the core-receiving passageways 138, 148 of the first and second bobbins, a gap is formed between the end surfaces of the core legs and the inner surface of the core body of the first core section. The first core section and the second core section are maintained in a juxtaposed relationship by tape or other suitable fastening devices.

Figure 44:
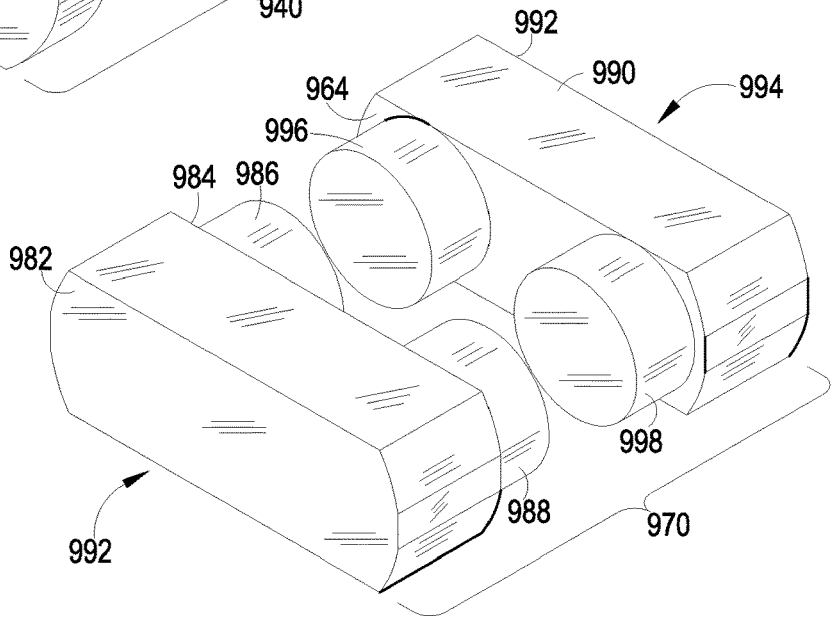
FIG. 44 illustrates an alternative core structure with two symmetrical core halves, wherein the respective core bodies have a shorter vertical profile.

FIG. 44 illustrates a further alternative core structure 970 having a configuration similar to the previously described core 120. The core structure comprises a first core section 970 and a second core section 972. The first core section comprises a core body 980 having an outer surface 982 and an inner surface 984. A first core leg 986 and a second core leg 988 extend from the inner surface of the core body of the first core section. The second core section comprises a core body 990 having an outer surface 992 and an inner surface 994. A first core leg 996 and a second core leg 998 extend from the inner surface of the core body of the first core section. The core legs have lengths that are sized as described above for the core legs of the core 120 of FIG. 3. The core structure differs from the core of FIG. 3 because the core bodies are thicker between the respective outer and inner surfaces and are shorter in a direction (vertical in the illustrated embodiment) perpendicular to the legs.

The previous detailed description is provided for the purposes of illustration and description. Although particular embodiments of a new and useful invention are described herein, references to the disclosed embodiments are not intended to be construed as limitations upon the scope of this invention except as set forth in the following claims.

What is claimed is:

1. A magnetic component for an electronic circuit, comprising:

a first bobbin and a second bobbin, each bobbin comprising:

a first flange at a first end of the bobbin and a second flange at a second end of the bobbin;

an elongated bobbin tube positioned between the first flange and the second flange, the bobbin tube defining a core-receiving passageway along a respective axis of elongation, the core-receiving passageway having a passageway length; and a plurality of slots defined in the bobbin tube, each slot oriented substantially transversely to the bobbin axis of elongation;

a first plurality of winding inserts, each winding insert of the first plurality of winding inserts positioned in a respective slot of the bobbin tube of the first bobbin, each winding insert of the first plurality of winding inserts having a first plurality of connector prongs extending from the winding insert;

a second plurality of winding inserts, each winding insert of the second plurality of winding inserts positioned in a respective slot of the bobbin tube of the second bobbin, each winding insert of the second plurality of winding inserts having a second plurality of connector prongs extending from the winding insert;

a first coil wound around the bobbin tube of the first bobbin in a clockwise direction, the first coil having a plurality of turns, each turn wound between adjacent ones of the first plurality of winding inserts or between one of the first plurality winding inserts and one of the first flange and the second flange of the first bobbin;

a second coil wound around the bobbin tube of the second bobbin in a counterclockwise direction, the second coil having a plurality of turns, each turn wound between adjacent ones of the second plurality of winding inserts or between one of the second plurality winding inserts and one of the first flange and the second flange of the second bobbin; and a magnetic core, the magnetic core comprising at least a first core leg and a second core leg, the first core leg positioned in the core-receiving passage of the first bobbin and the second core leg positioned in the core-receiving passage of the second bobbin.

2. The magnetic component as defined in claim 1, wherein:

the first bobbin is positioned on the first leg of the magnetic core with the first plurality of connector prongs directed in a first direction; and the second bobbin is positioned on the second leg of the magnetic core with the second plurality of connector prongs directed in a second direction, the second direction different from the first direction.

3. The magnetic component as defined in claim 2, wherein the second direction is opposite the first direction.

4. The magnetic component as defined in claim 2, wherein:

the first plurality of connector prongs are engageable with a first printed circuit board; and the second plurality of connector prongs are engageable with a second printed circuit board.

5. The magnetic component as defined in claim 4, wherein the second printed circuit board is parallel with the first printed circuit board.

6. The magnetic component as defined in claim 1, wherein each winding insert comprises:

a first conductive sheet having a respective central opening;

a second conductive sheet having a respective central opening; and an insulating sheet positioned between the first conductive sheet, the insulating sheet having a respective central opening.

7. The magnetic component as defined in claim 6, wherein:

the central openings of the first conductive sheet, the second conductive sheet and the insulating sheet are sized to accommodate an outer periphery of one of the first core leg and the second core leg.

8. The magnetic component as defined in claim 7, wherein:

each conductive sheet and the insulating sheet of each winding insert has a respective centerline and has a respective first side and a respective second side;

each conductive sheet includes:

a first connector stub having at least a first connector prong extending therefrom, the first connector stub positioned a first distance from the centerline of the conductive sheet in a first lateral direction; and a second connector stub having at least a second connector prong extending therefrom, the second connector stub positioned a second distance from the centerline of the conductive sheet in a second lateral direction opposite the first lateral direction, the second distance greater than the first distance;

the first conductive sheet is positioned on a first side of the insulating sheet with the second side of the first conductive sheet adjacent to the first side of the insulating sheet such that the first connector prong positioned in the first direction with respect to the centerline of the insulating sheet; and the second conductive sheet is positioned on a second side of the insulating sheet with the second side of the second conductive sheet adjacent to the second side of the insulating sheet such that the first connector prong of the second conductive sheet is positioned in the second direction with respect to the centerline of the insulating sheet.

9. The magnetic component as defined in claim 1, wherein:

the magnetic core comprises a first core section and a second core section, each core section comprising:

a core body having an inner surface and an outer surface;

a first core leg extending from the inner surface; and a second core leg extending from the inner surface, the second core leg spaced apart from the first core leg by a selected distance.

10. The magnetic component as defined in claim 9, wherein:

the selected distance is chosen such that the core-receiving passageways of the first and second bobbins are positionable on the first and second core legs without interference.

* * * * *